US008824939B2

(12) United States Patent
Yamamoto et al.

(10) Patent No.: US 8,824,939 B2
(45) Date of Patent: Sep. 2, 2014

(54) IMAGE FORMING APPARATUS WITH BELT POSITION CONTROL FEATURE

(75) Inventors: Shinji Yamamoto, Kawasaki (JP); Yasumi Yoshida, Yokohama (JP); Toshihiro Fukasaka, Kawasaki (JP); Tadashi Matsumoto, Tokyo (JP); Takashi Hiratsuka, Tokorozawa (JP); Sumitoshi Sotome, Yachiyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 261 days.

(21) Appl. No.: 13/037,676

(22) Filed: Mar. 1, 2011

(65) Prior Publication Data

US 2011/0217090 A1 Sep. 8, 2011

(30) Foreign Application Priority Data

Mar. 4, 2010 (JP) ..... 2010-047891

(51) Int. Cl.
*G03G 15/00* (2006.01)
*G03G 15/01* (2006.01)

(52) U.S. Cl.
USPC ..... 399/302; 399/165

(58) Field of Classification Search
USPC ..... 399/302, 165
See application file for complete search history.

(56) References Cited

U.S. PATENT DOCUMENTS 5,157,444 A * 10/1992 Mori et al. ..... 399/329
5,481,338 A * 1/1996 Todome ..... 399/361
5,515,139 A * 5/1996 Hou et al. ..... 399/38
5,619,310 A * 4/1997 Todome ..... 399/381
5,896,979 A * 4/1999 Hokari et al. ..... 198/807
6,055,397 A * 4/2000 Lee ..... 399/165
6,195,518 B1 * 2/2001 Bennett et al. ..... 399/165
8,238,793 B2 8/2012 Nakura et al.
2003/0219280 A1 * 11/2003 Lee ..... 399/167
2006/0284363 A1 12/2006 Matsumoto et al.
2007/0147894 A1 * 6/2007 Yokota ..... 399/165
2007/0231021 A1 * 10/2007 Kinoshita et al. ..... 399/301

(Continued)

FOREIGN PATENT DOCUMENTS

CN 1877458 A 12/2006
CN 101493670 A 7/2009

(Continued)

OTHER PUBLICATIONS

Notification of the First Office Action dated Apr. 27, 2013, in Chinese Application No. 201110051380.8.

*Primary Examiner* — David Bolduc
(74) *Attorney, Agent, or Firm* — Fitzpatrick, Cella, Harper & Scinto

(57) ABSTRACT

An image forming apparatus includes an image bearing member; a rotatable belt member; a rotatable supporting roller for stretching the belt member; and a steering roller controlled by motors for stretching the belt member and for moving the belt member in a widthwise direction by an inclining operation. A number of sensors detect the position of the belt member in the widthwise direction and produce an output, causing a first controller to change the amount of the inclining operation of the steering roller in order to counter the force moving the belt member in the widthwise direction. The output of the sensors also causes a second controller to change the amount of the inclining operation of the steering roller in short intervals to reduce the rapid positional deviation of the belt member attributable to the inclination of the steering roller.

8 Claims, 18 Drawing Sheets

(56) References Cited

U.S. PATENT DOCUMENTS

| | | | | |
|---|---|---|---|---|
| 2008/0213009 | A1* | 9/2008 | Kamoshita et al. | 399/313 |
| 2008/0279572 | A1* | 11/2008 | Nakatsu | 399/17 |
| 2009/0123197 | A1 | 5/2009 | Okumura et al. | |
| 2009/0145729 | A1* | 6/2009 | Enomoto | 198/807 |
| 2009/0148198 | A1* | 6/2009 | Suzuki et al. | 399/301 |
| 2009/0169274 | A1* | 7/2009 | Suzuki et al. | 399/302 |
| 2009/0180805 | A1 | 7/2009 | Nakura et al. | |
| 2010/0158553 | A1* | 6/2010 | Ueno | 399/67 |
| 2010/0158568 | A1* | 6/2010 | Yasumoto | 399/165 |
| 2010/0158585 | A1* | 6/2010 | Yasumoto | 399/313 |
| 2010/0239330 | A1* | 9/2010 | Nakagawa | 399/297 |
| 2010/0310286 | A1* | 12/2010 | Yasumoto | 399/302 |
| 2011/0049795 | A1* | 3/2011 | Yamaguchi | 271/264 |
| 2011/0110691 | A1* | 5/2011 | Hirose et al. | 399/302 |
| 2011/0200343 | A1 | 8/2011 | Matsumoto et al. | |
| 2012/0082473 | A1* | 4/2012 | Hara et al. | 399/66 |
| 2012/0257915 | A1 | 10/2012 | Nakura et al. | |

FOREIGN PATENT DOCUMENTS

| | | | |
|---|---|---|---|
| JP | 2000-233843 | A | 8/2000 |
| JP | 2004-229353 | A | 8/2004 |
| JP | 2008-129518 | A | 6/2008 |

* cited by examiner

TRANS. SURFACE FORMING ROLLER 32A
ADJACENT STEERING (a)

(b)

IMAGE FORMING APPARATUS WITH BELT POSITION CONTROL FEATURE

FIELD OF THE INVENTION AND RELATED ART

The present invention relates to an image forming apparatus which tilts its belt steering roller to accurately position its belt in terms of the widthwise direction of the recording medium passage. More specifically, it relates to an image forming apparatus having a belt steering system controllable to prevent (minimize) the positional deviation of the belt in the widthwise direction of the recording medium passage, which is attributable to the vibrant movement of one or more of the belt supporting rollers.

An image forming apparatus designed so that as its belt (intermediary transfer belt and/or recording medium bearing belt) deviates in position in the widthwise direction of the recording medium passage, the apparatus dynamically corrects the belt in position in terms of the widthwise direction of the recording medium passage, by tilting the belt steering roller of the apparatus, and has been put to practical usage. Further, an image forming apparatus which has a steerable belt and forms a full-color image on recording medium forming multiple toner image, different in color, on multiple image bearing members, one for one, and placing the multiple toner images on the steerable belt, has also been put to practical usage (FIG. 1).

Japanese Laid-open Patent Application 2008-129518 discloses an image forming apparatus which controls the amount (angle) by which it tilts its belt steering roller, in order to cancel the amount by which the belt is made to deviate in position in terms of the widthwise direction of the recording medium passage by the vibrant movement of the belt steering roller, which occurs as the belt steering roller is rotated. More specifically, in the case of this image forming apparatus, the amount by which the belt has deviated in position is detected by a belt position detecting means, and the amount (angle) by which the belt steering roller is to be tilted is controlled in proportion to the detected amount of the positional deviation of the belt in order to make the belt to move in the direction to cancel the amount of this positional deviation.

Japanese Laid-open Patent Application 2004-229353 discloses an image forming apparatus which controls its belt driving motor in a manner to cancel the oscillatory positional deviation of the belt in the widthwise direction of the recording medium passage, which occurs with a frequency which corresponds to the rotational frequency of the belt.

Generally speaking, if the peripheral surface of a belt supporting roller is not parallel to the axial line of the belt supporting roller, the belt supporting roller wobbles (nutates like pestle which is being used for grinding). This wobbling (nutation) of the belt supporting roller causes the belt to shake (vibrate) in the widthwise direction of the recording medium passage (FIG. 4) as the belt supporting roller rotates. The amount of this positional deviation of the belt in the widthwise direction of the recording medium passage is in a range of several micrometers to 10 micrometers. In other words, it is very small, but sometimes results in the formation of images which suffer from color deviation.

In comparison to the belt shift attributable to the rotation of the belt, the vibrant belt shift in the widthwise direction of the recording medium passage, which is attributable to the wobbling (nutation) of the belt supporting roller, is short in the intervals with which it occurs. Therefore, it is difficult to deal with the latter with the use of any of the conventional steering controls, since the conventional steering controls are for dealing with the former. That is, as the amount by which the steering roller is to be tilted is changed, the speed with which the belt is laterally shifted (that is, shifted in the widthwise direction of the recording medium passage) changes in proportion to the change in the angle of the steering roller. Thus, the amount by which the belt has deviated in position in the widthwise direction of the recording medium passage is cancelled by the integration of the speed by which the belt is laterally shifted by the tilting of the steering roller. However, by the time the lateral speed of the belt is integrated, the belt supporting roller will have rotated 180 degrees, and therefore, the vibrant belt movement attributable to the belt supporting roller will have reversed in direction.

As one of the solutions for the above described problem, it is possible to increase the belt steering system in gain in order to increase the belt steering system in the amount by which the steering roller is to be tilted in proportion to the amount of the positional deviation of the belt. This solution increases the belt steering system in the response to the changes in the belt position. However, it interferes with the control for the snaking of the belt, and therefore, it makes it difficult to make the belt converge to a preset position.

Thus, it is possible to provide the steering control system with a mechanism for moving the belt, together with the steering roller, in the direction parallel to the rotational axis of the steering roller, so that the belt and steering roller can be moved together in the widthwise direction of the recording medium passage. This solution, however, increases a belt steering system (image forming apparatus) in size.

SUMMARY OF THE INVENTION

The primary object of the present invention is to provide an image forming apparatus which is smaller in the amount of the rapid and vibrant positional deviation of its belt, which is attributable to its belt supporting roller, and yet, is significantly smaller in size, than any of conventional image forming apparatuses capable of controlling its belt steering system in the positional deviation of the belt.

According to an aspect of the present invention, there is provided an image forming apparatus comprising an image bearing member; a rotatable belt member for carrying a toner image transferred from said image bearing member or for carrying a recording material carrying a toner image transferred from said image bearing member; a rotatable supporting roller for stretching said belt member; a steering roller for stretching said belt member and for moving said belt member in a widthwise direction by inclining operation; detecting means for detecting a position of said belt member with respect to the widthwise direction; first control means, responsive to an output of said detecting means, for controlling an amount inclining operation of said steering roller to control a force of moving said belt member in the widthwise direction; and second control means, responsive to an output of said detecting means, for controlling an amount inclining operation of said steering roller to displacing said belt member in the widthwise direction.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention are described in detail with reference to the appended drawings. The present invention is applicable to image forming apparatuses other than those in the following embodiments of the present invention, as long as they are structured so that their belt is controlled in its movement in the widthwise direction of the recording medium passage, which is directly caused by the tilting of their belt steering roller, even if they are partially or entirely different in structure from those in the following embodiments.

In other words, the present invention is applicable to any image forming apparatus which employs a steerable belt, regardless of whether the apparatus is of the tandem type or single drum type, and whether the apparatus is of the intermediary transfer type or direct transfer type. Further, in the following description of the preferred embodiments of the present invention, only the portions of an ordinary image forming apparatus, which are essential to the formation and transfer of toner images, are described. However, the present invention is also applicable to image forming apparatuses other than those in the following embodiments. That is, the present invention is also applicable to various printers, copying machines, facsimile machines, multifunction image forming apparatuses, etc., which are combinations of an image forming apparatus similar to those in the following embodiments of the present invention, additional equipment and frames, etc.

<Image Forming Apparatus>

Figure 1:
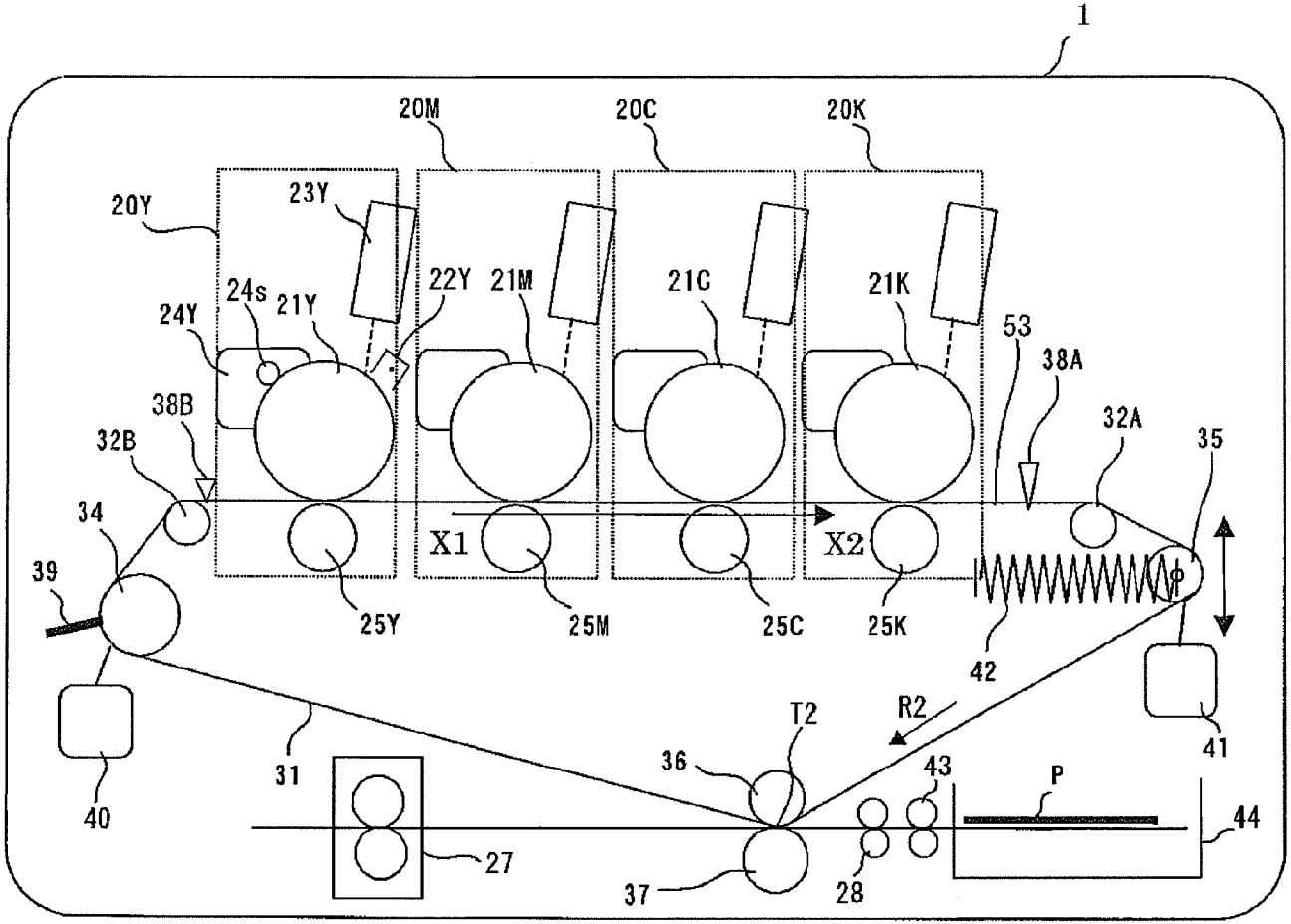
FIG. 1 is a schematic drawing for describing the structure of the image forming apparatus in the first preferred embodiment of the present invention.

FIG. 1 is a drawing for describing the structure of an image forming apparatus 1. Referring to FIG. 1, the image forming apparatus 1 is a full-color printer of the tandem type. It is also of the intermediary transfer type. It has an intermediary transfer belt 31, image forming portions 20Y, 20M, 20C, and 20K for forming yellow, magenta, cyan, and black monochromatic toner images, respectively. The image forming portions 20 are in the adjacencies of the intermediary transfer belt 31, being in alignment with each other in the moving direction of the belt 31.

In the image forming portion 20Y, a yellow toner image is formed on a photosensitive drum 21Y, and is transferred (first transfer) onto the intermediary transfer belt 31. In the image forming portion 20M, a magenta toner image is formed on a photosensitive drum 21M, and is transferred (first transfer) onto the intermediary transfer belt 31 in such a manner that it is layered upon the yellow toner image on the intermediary transfer belt 31. In the image forming portion 20C, a cyan toner image is formed on a photosensitive drum 21C, and is transferred (first transfer) onto the intermediary transfer belt 31 in such a manner that it is layered on the yellow and magenta toner images on the intermediary transfer belt 31. In the image forming portion 20K, a black toner image is formed on a photosensitive drum 21K, and is transferred (first transfer) onto the intermediary transfer belt 31 in such a manner that it is layered on the yellow, magenta, and cyan images on the intermediary transfer belt 31.

The layered four monochromatic toner images, different in color, on the intermediary transfer belt 31 are conveyed to a second transfer portion T2, and are transferred together (second transfer) onto a sheet P of recording medium in the second transfer portion T2. After the transfer of the layered four monochromatic images, that is, a full-color toner image made up of four monochromatic toner images different in color, onto the sheet P of recording medium, the sheet P is separated from the intermediary transfer belt 31 with the utilization of the curvature which the intermediary transfer belt 31 forms, and is sent into a fixing apparatus 27. The fixing apparatus 27 fixes the layered four monochromatic toner images on the sheet P to the surface of the sheet P by the application of heat and pressure. Thereafter, the sheet P is discharged from the image forming apparatus 1.

The image forming apparatuses 20Y, 20M, 20C, and 20K are virtually the same in structure, although they are different in that they use developing apparatuses 24Y, 24M, 24C, and 24K, which use yellow, magenta, cyan, and black toners, respectively. Hereafter, therefore, only the yellow image forming portion 20Y is described, since the descriptions of the other image forming portions 20M, 20C, and 20K are the same as that of the yellow image forming portion 20Y except for the suffix Y of the referential codes for the structural components, which has to be replaced with M, C, and K, respectively.

The image forming portion 20Y has a photosensitive drum 21Y. It has also a charging device 22Y of the corona-type, an exposing apparatus 23Y, a developing apparatus 24Y, a first transfer roller 25Y, and a drum cleaning apparatus 26Y, which are in the adjacencies of the peripheral surface of the photosensitive drum 21Y.

The photosensitive drum 21Y, which is an example of an image bearing member, has a photosensitive surface layer which is negatively chargeable. It is rotated in the direction indicated by an arrow mark R1 at a process speed of 300 mm/sec. The charging device 22Y of the corona-type negatively charges the peripheral surface of the photosensitive drum 21Y to a preset level (pre-exposure potential level VD) by discharging charged electrical particles (corona). The exposing apparatus 23Y writes an electrostatic image on the peripheral surface of the photosensitive drum 21Y by scanning the charged portion of the peripheral surface of the photosensitive drum 21Y with the beam of laser light which it projects upon its rotating mirror while modulating (turning on and off) the beam of laser light according to the image formation data obtained by developing the data of the yellow monochromatic image obtained by separating the image to be formed, into monochromatic images.

The developing apparatus 24Y charges two-component developer made up of nonmagnetic toner and magnetic carrier, and conveys the charged two-component developer to the interface between the peripheral surface of its development sleeve 24*s* and the peripheral surface of the photosensitive drum 21Y, by causing the charged two-component developer to be borne on the peripheral surface of the development sleeve 24*s*. To the development sleeve 24*s*, an oscillatory voltage, which is a combination of a DC voltage and an AC voltage, is applied, whereby the negatively charged nonmagnetic toner on the peripheral surface of the development sleeve 24*s* is made to transfer onto the exposed portions of the peripheral surface of the photosensitive drum 21Y, which have been made positively charged relative to the potential level of the negatively charged toner, by the exposure. That is, the electrostatic image on the peripheral surface of the photosensitive drum 21Y is developed in reverse.

The first transfer roller 25Y forms the first transfer portion T1 between the outward surface (with reference to the loop which the intermediary transfer belt 31 forms) of the intermediary transfer belt 31 and the peripheral surface of the photosensitive drum 21Y, by pressing on the inward surface of the intermediary transfer belt 31. As a positive voltage is applied to the first transfer roller 25Y, the toner image formed on the peripheral surface of the photosensitive drum 21Y is transferred (first transfer) onto the intermediary transfer belt 31. The drum cleaning apparatus 26Y recovers the toner (transfer residual toner) remaining on the peripheral surface of the photosensitive drum 21Y after the first transfer, by rubbing the peripheral surface of the photosensitive drum 21Y with its cleaning blade.

The second transfer roller 37 forms the second transfer portion T2 by being placed in contact with the portion of the intermediary transfer belt 31, which is supported by a belt supporting roller 36, from within the inward side of the belt loop. A recording sheet cassette 44 holds multiple sheets P of recording medium. Each sheet P of recording medium in the cassette 44 is fed into the main assembly of the image forming apparatus 1 by a separation roller 43 while being separated from the rest of the sheets P of recording medium in the cassette 44. Then, it is sent to a pair of registration rollers 28, which catches the sheet P, while remaining stationary, and keeps the sheet P on standby. Then, the pair of registration rollers 28 release the sheet P with such timing that the sheet P and the toner image on the intermediary transfer belt 31 arrive at the second transfer portion T2 at the same time.

While the full-color toner image, that is, the layered four monochromatic toner images, different in color, on the intermediary transfer belt 31, and the sheet P of recording medium, are conveyed through the second transfer portion T2, remaining pinched together between the intermediary transfer belt 31 and second transfer roller 37, a positive DC voltage is applied to the second transfer roller 37, whereby the full-color toner image is transferred (second transfer) from the intermediary transfer belt 31 onto the sheet P of recording medium. As for the toner (transfer residual toner) remaining on the surface of the intermediary transfer belt 31, that is, the toner on the surface of the intermediary transfer belt 31, which was not transferred onto the sheet P, it is recovered by the belt cleaning apparatus 39.

<Belt Unit>

An image forming apparatus which employs an endless belt needs to be corrected in the position of the belt in terms of the widthwise direction of the recording medium passage while the belt is driven. That is, it needs to be rid of the positional deviation (rapid and oscillatory movement, snaking, etc.), of its belt in the widthwise direction of the recording medium passage. The positional deviation of the belt in the widthwise direction of the recording medium passage, which occurs while the belt is driven, is attributable to the impreciseness of the belt driving mechanism, structural impreciseness of the belt itself, changes in the properties of the belt, vibrations which occur the moment when recording medium comes into contact with the belt, various external forces which apply to the belt, and the like factors. Further, the amount by which the belt is made to deviate in position is affected by the amount and extent of these factors. One of the main causes for the positional deviation of the belt is that force which works on the belt in the direction parallel to the widthwise direction of the belt is generated because the rollers by which the belt is supported are not parallel to each other.

There have been known various methods for correcting an image forming apparatus in the positional deviation of its belt in the widthwise direction of the recording medium passage. One of these methods is to detect the belt position in terms of its widthwise direction, and control the amount by which a belt steering roller is to be tilted, according to the detected belt position.

In the case of the image forming apparatus 1, it is provided with a belt edge sensor 38A for detecting the position of one of the lateral edges of the intermediary transfer belt 31, and also, a belt steering roller 35 which can be adjusted in the amount (angle) by which it is to be tilted. It is controlled so that the amount (angle) by which the belt steering roller 35 is to be tilted is dynamically adjusted to correctly position the intermediary transfer belt in terms of the widthwise direction of the recording medium passage.

A belt unit 30 is made up of the intermediary transfer belt 31, and a set of four rollers, more specifically, a driver roller 34, a transfer surface forming roller 32A, a transfer surface forming roller 32B, a belt steering roller 35 (which hereafter will be referred to simply as steering roller 35), and the belt backing roller 36, by which the intermediary transfer belt 31 is supported and kept stretched. The intermediary transfer belt 31 is rotated by the driver roller 34 in the direction indicated by an arrow mark R2 at a process speed of 300 mm/sec. The main assembly of the image forming apparatus is structured so that the belt unit 30 can be replaced along with the aforementioned first transfer rollers 25 (25Y, 25M, 25C, and 25K).

The steering roller 35 is positioned so that it opposes the driver roller 34, with the presence of a first transfer surface 53 between itself and the driver roller 34. As it rotates in the direction of the arrow mark R2 by being driven by the driver roller 34 which is driven by the belt driving motor 40, it moves a given point of the first transfer surface 53 in the direction indicated by an arrow mark X1-X2. The first transfer surface 53 is kept flat by the transfer surface forming roller 32A (which is in the adjacencies of steering roller 35) and transfer surface forming roller 32B (which is in the adjacencies of driver roller 34). Further, the belt unit 30 is provided with a pair of belt edge sensors 38B and 38A. The belt edge sensor 38B is in the adjacencies of the driver roller 34 side of the transfer surface formation roller 32B, and detects the amount by which the intermediary transfer belt 31 has deviated in position on the upstream side of the first transfer surface 53. The belt edge sensor 38A is in the adjacencies of the steering roller 35 side of the transfer surface formation roller 32A, and detects the amount of positional deviation of the belt, on the downstream side of the first transfer surface 53.

<Steering Mechanism>

Figure 2:
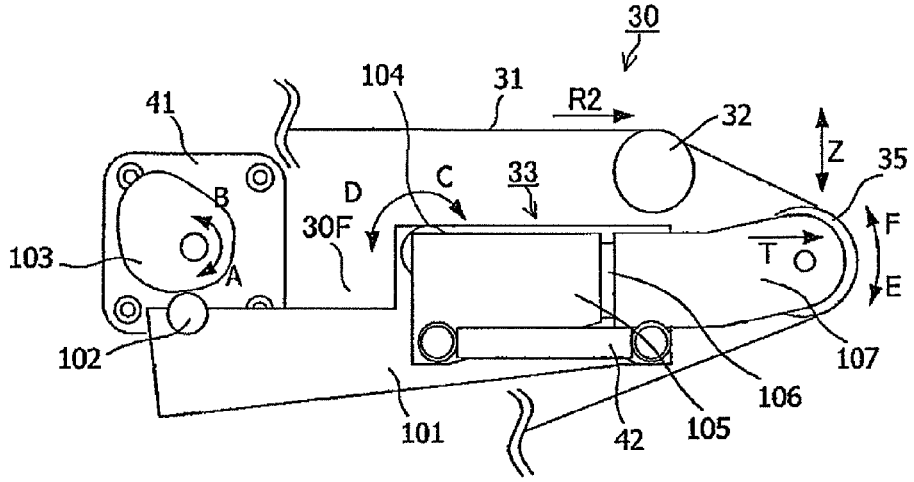
FIG. 2 is a schematic drawing for describing the structure of the belt steering mechanism in the first embodiment.

FIG. 2 is a drawing for describing the structure of the belt steering mechanism 33 (which hereafter will be referred to simply as steering mechanism 33). Referring to FIG. 2, the steering mechanism can tilt the steering roller 35 in such a manner that the front end of the steering roller 35 moves in the direction indicated by an arrow mark Z to control the speed with which the intermediary transfer belt 31 shifts in position in its widthwise direction.

The steering roller 35 is supported at its lengthwise ends, by a pair of bearings 107 (holders), one for one, which are perpendicular to the surface of a recording medium (paper) and are parallel to each other. Thus, the steering roller 35 is rotatable. The steering mechanism has also a pair of sliders 105. The bearings 107 (holders) and sliders 105 are attached to the steering arms 101, with the presence of a slider rail 106 between each bearing 107 and corresponding steering arm 101, and between each slider 105 and corresponding steering arm 101. Thus, the bearings 107 and sliders 105 are movable along the steering arms 101 while being guided by the slider rails 106.

One end of the slider rail 106 is solidly attached to the bearing 107 (holder) and slider 105, and the other end of the slider rail 106 is solidly attached to the steering arm 101.

The belt unit 30 is also provided with a compression spring 42, one end of which is attached to the slider 106, and the other end of which is attached to the steering arm 101. The compression spring 42 keeps the slider 105 and bearing 107 (holder) pressed in the direction indicated by an arrow mark T. Thus, the bearing 107 keeps the steering roller 35 pressed on the inward surface of the intermediary transfer belt 31 while being allowed to slide on the steering arm 101 in the direction of the arrow T. Thus, the intermediary transfer belt 31 is provided with tension. In other words, the steering roller 35 doubles as a tension roller for providing the intermediary transfer belt 31 with a preset amount of tension. That is, the steering roller 35, which is within the loop formed by the intermediary transfer belt 31, is kept pressed outward of the belt loop at its lengthwise end, providing thereby the intermediary transfer belt 31 with a preset amount of tension.

The front and rear sides of the steering mechanism are similar in structure in that both are made up of the slider rail 106, bearing holder 107, slider 105, steering arm 101, and compression spring 42. However, while the rear steering arm (unshown) is solidly attached to the frame of the belt unit 30, the steering arm 101, or the front steering arm, is attached to the frame of the belt unit 30 so that it can be rotationally moved about a shaft 104 in an oscillatory manner. Therefore, the steering roller 35 can be tilted by rotationally (virtually vertically) moving the bearing holder 107 as if the rear bearing holder (unshown) is the center of rotation of the front steering roller 35.

The steering system is also provided with a cam follower 102 for rotationally moving the steering arm 101 (front steering arm) about the shaft 104 in an oscillatory manner. The cam follower 102 is on the opposite side of the steering arm 101 from the steering roller 35, and is fitted around its own shaft. Further, the steering system is provided with a cam 103, which is in contact with the cam follower 102, and is rotated by a steering motor 41 solidly attached to the frame of the belt unit 30.

As the steering motor 41 rotates the cam 103 in the direction indicated by an arrow mark A, the steering arm 101 is rotated about the shaft 104 in such a direction that the cam follower side of the steering arm 101 moves in the direction indicated by an arrow mark C. Thus, the opposite end of the steering roller 35 from the cam follower 102 moves in the direction indicated by an arrow mark E. In other words, the steering roller 35 is tilted in the direction to lower its front end. Thus, the intermediary transfer belt 31, which is rotating in the direction of the arrow mark R2, is subjected to such a force that causes the belt to shift rearward at a speed proportional to the amount (angle) by which the steering roller 35 was tilted.

On the other hand, as the steering motor 41 rotates the cam 103 in the direction indicated by an arrow mark B, the steering arm 101 is rotated about the shaft 104 in such a direction that the cam follower side of the steering arm 101 moves in the direction indicated by an arrow mark D. Thus, the opposite end of the steering roller 35 from the cam follower 102 moves in the direction indicated by an arrow mark F. In other words, the steering roller 35 is tilted in the direction to raise its front end. Thus, the intermediary transfer belt 31, which is rotating in the direction of the arrow mark R2, is subjected to such a force that cause the belt to shift front at a speed proportional to the amount (angle) by which the steering roller 35 was tilted.

Incidentally, the image forming apparatus 1 is structured so that the steering roller 35 is made to double as a member for providing the intermediary transfer belt 31 with tension. However, an image forming apparatus may be structured so that the belt supporting roller which provides the intermediary transfer belt 31 with tension is different from the belt supporting roller which steers the intermediary transfer belt 31.

Further, the image forming apparatus 1 is structured so that the bearing holder 107 (front bearing holder) is vertically moved as if the rear bearing holder (unshown) were the center of the rotational movement of the front bearing holder 107. However, the rear side of the belt steering system also may be provided with the steering roller tilting mechanism similar to the one with which the front side is provided, so that the steering roller 35 can be tilted to raise either of its front and rear ends. In the case where the steering system is structured so that the steering roller can be tilted to raise either or its front and rear ends, the front and rear side of the steering system may be made opposite in the direction in which the corresponding lengthwise ends of the steering roller 35 move in an oscillatory manner, and the same in the absolute value in the amount by which they are moved, so that the steering roller 35 is tilted as if the lengthwise center of the steering roller 35 is the center of the rotation for the tilting of the steering roller 35.

<Belt Edge Sensors>

Figure 3:
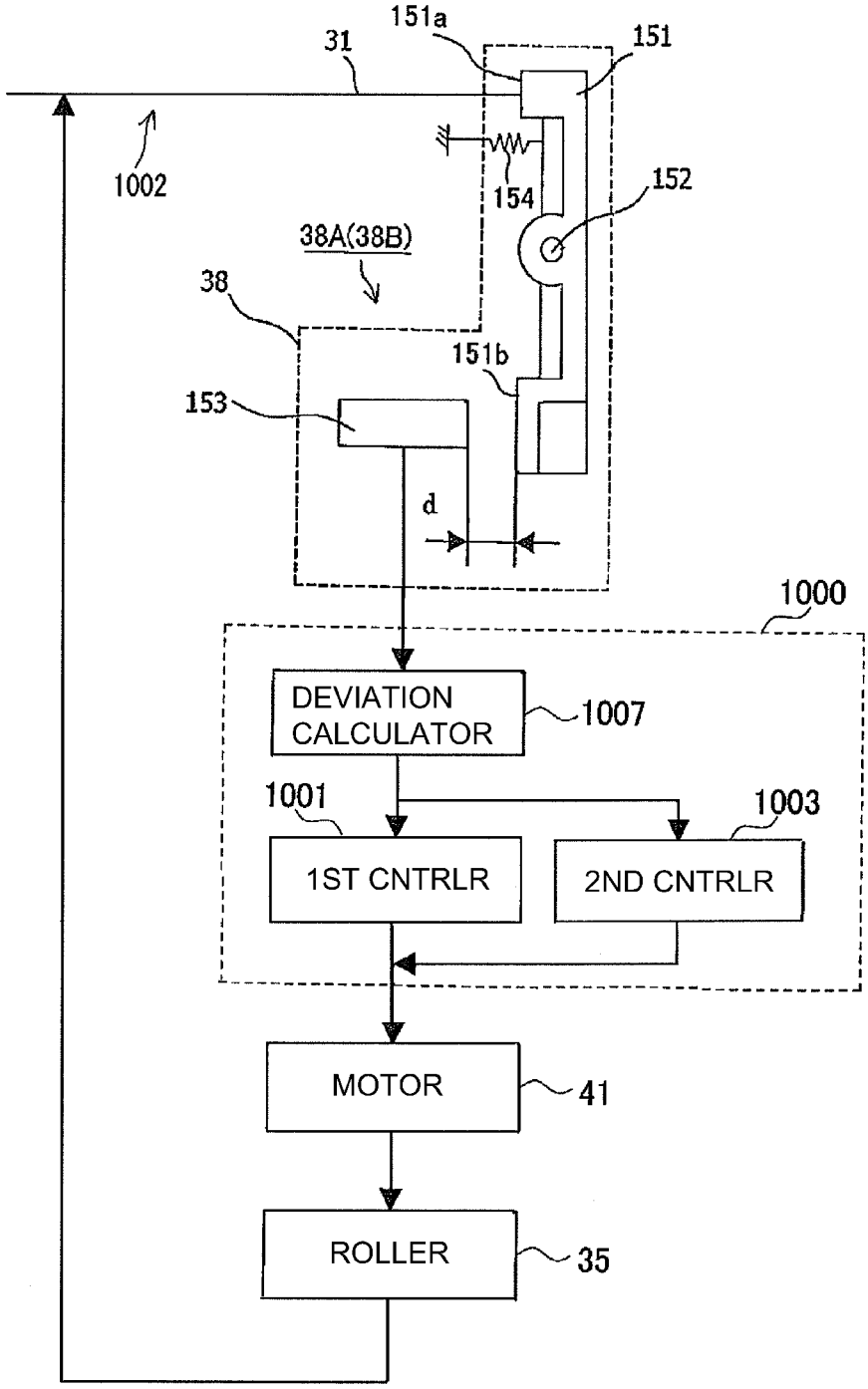
FIG. 3 is a schematic drawing for describing the belt edge sensors in the first embodiment.

FIG. 3 is a drawing for describing the belt edge sensors. Referring to FIG. 3, a belt edge sensor 38A (38*b*) is made up of a belt displacement sensor 153, and an arm 151 to which the sensor 153 is attached. The arm 151 is rotatable about its axle 152. It is under the pressure applied thereto by a tension spring 154 in the counterclockwise direction. Therefore, its guiding portion 151*a* remains in contact with one of the lateral edges of the intermediary transfer belt 31. The belt edge detecting surface 151*b* of the arm 151 faces the belt displacement sensor 153, with the presence of a distance d between the surface 151*b* and sensor 153. Thus, the change in position of the point of contact between the belt edge and guiding portion 151*a* causes the arm 151 to rotationally move, changing the distance d between the detecting surface 151*b* and belt displacement sensor 153. The belt displacement sensor 153 outputs a voltage, the amount of which reflects the distance d. That is, as the intermediary transfer belt 31 shifts in its widthwise direction, the point of contact between the belt edge and guiding portion 151*a* changes in position. Consequently, the output voltage of the belt edge sensor 38A (38B) changes in proportion to the amount of change in the belt position.

The belt edge sensor 38A (38B) directly detects the amount of belt displacement by being directly in contact with one of the lateral edges of the intermediary transfer belt 31. Therefore, the pattern in which the amount of distance a given point of the lateral edge of the intermediary transfer belt 31 is moved in the widthwise direction of the recording medium passage per rotation of the intermediary transfer belt 31 shows the amount of error in the detected amount of the belt displacement. In the case of the image forming apparatus 1, therefore, in order to minimize the belt edge position detecting means in the belt position detection error attributable to the abovementioned oscillatory movement of a given point of the belt edge in the widthwise direction of the recording medium passage, the image forming apparatus 1 is designed to obtain the profile (shape) of the belt at the beginning of the belt shift control operation. Then, while the intermediary transfer belt 31 is actually controlled in position, a value which reflects the profile of the belt edge is subtracted from the value which indicates each of the belt positions detected with preset intervals in time, in order to obtain the belt displacement amount which is free of the effect of the belt shape (profile).

Incidentally, in this embodiment, a belt edge sensor of the contact type was used to detect the amount of the belt displacement. However, a belt edge sensor of the noncontact type, for example, a sensor, which detects (reads) the marks drawn on a belt, holes made through a belt, or the likes, may be employed instead of a belt edge sensor of the contact type.

One of the primary reasons why the intermediary transfer belt 31 shifts in position in the widthwise direction of the recording medium passage is inaccuracy with which one or more of the belt supporting rollers of the belt unit 30 rotate. More specifically, unless the peripheral surface of one, for example, of the belt supporting rollers, is not parallel to the axial line of the roller, the roller wobbles (nutates) (like a pestle which is being used for grinding) as it is rotated. Thus, the intermediary transfer belt 31 oscillates (vibrates) in its widthwise direction with the frequency which corresponds to the rotational frequency of the supporting roller. In order to prevent the intermediary transfer belt 31 from slipping on the peripheral surface of the steering roller 35 and the peripheral surface of the driver roller 34, the belt unit 30 is structured so that the steering roller 35 and driver roller 34 are relatively large in the angle of contact relative to the intermediary transfer roller 31. Therefore, the accuracy with which the steering roller 35 and driver roller 34 are rotated substantially affects the aforementioned positional deviation of the intermediary transfer belt 31 in the widthwise direction of the recording medium passage.

In the following preferred embodiments of the present invention, the direct belt displacement (belt displacement which occurs with no relation to the rotation of the steering roller) in the widthwise direction of the recording medium passage, which is caused by the tilting of the steering roller, is used to cancel the positional belt deviation which is caused by the rotation of the transfer surface formation roller 32A and/or transfer surface formation roller 32B, with a frequency which corresponds to the rotational frequency of the rollers 32A and/or 32B.

<Method for Controlling Vibrant Lateral Displacement of Belt Using Direct Lateral Shift of Belt Caused by Tilting of Steering Roller>

Figure 4:
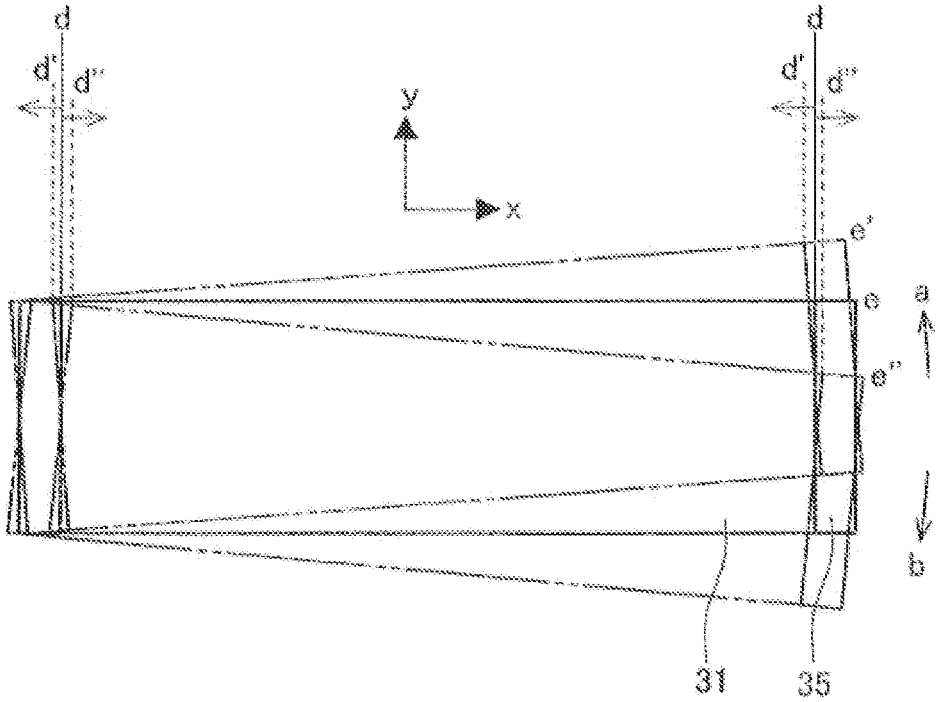
FIG. 4 is a drawing for describing the movement of the belt in the widthwise direction of the recording medium passage, which is directly caused by the tilting of the belt steering roller.

FIG. 4 is a drawing for describing the direct lateral shifting of the intermediary transfer belt 31, which is caused by the tilting of the steering roller 35. Referring to FIG. 4, as the steering roller 35 is tilted, the intermediary transfer belt 31 becomes twisted. Thus, the intermediary transfer belt 31 moves in its widthwise direction. More specifically, if the steering roller 35 is tilted in the direction indicated by an arrow mark a, the lengthwise ends of the steering roller 35 move from a position e (initial position) to a position e', and the corresponding edge of the intermediary transfer belt 31 moves from a position d (initial position) to a position d'. On the other hand, if the steering roller 35 is tilted in the direction indicated by an arrow mark b, the lengthwise ends of the steering roller 35 move from the position e (initial position) to a position e", and the aforementioned belt edge of the intermediary transfer belt 31 moves from the position d (initial position) to a position d".

The movement of the intermediary transfer belt 31, which is caused in the widthwise direction of the recording medium passage by the tilting of the steering roller 35 with no relation to the rotation of the steering roller 35, causes the entirety of the intermediary transfer belt 31 to shift in the widthwise direction of the recording medium passage as the steering roller 35 rotates after the tilting of the steering roller 35. The amount by which the intermediary transfer belt 31 is made to shift in position in the widthwise direction of the recording medium passage, by the tilting of the steering roller 35, with no relation to the rotation of the steering roller 35, is proportional to the radius of the steering roller 35 and the angle by which the steering roller 35 is tilted. The direct widthwise movement of the intermediary transfer roller 31, that is, the movement of the intermediary transfer belt 31 in the widthwise direction of the recording medium passage, which is caused by the tilting of the steering roller 35 with no relation to the rotation of the steering roller 35, is faster in response than the indirect widthwise movement of the intermediary transfer roller 31, that is, the movement of the intermediary transfer roller 31, which is caused by the rotation of the steering roller 35 in the widthwise direction of the recording medium passage after the tilting of the steering roller 35, and the apparent speed of which is the integration of the speeds relative to the angle of the steering belt 35. Therefore, the vibrant movement of the intermediary transfer belt 31 in the widthwise direction of the recording medium passage, which occurs with a frequency which corresponds to the rotational frequency of the transfer surface formation roller 32A, can be timely cancelled with the utilization of the aforementioned direct movement of the intermediary transfer belt 31 in the widthwise direction of the recording medium passage, which can be instantly caused by the tilting of the steering roller 35. That is, the intermediary transfer belt 31 can be made to converge to a preset position, in terms of the widthwise direction of the recording medium passage, by detecting the amount of the positional deviation of the intermediary transfer belt 31 in the widthwise direction of the recording medium passage, which occurs with a frequency which corresponds to the rotational frequency of the transfer surface formation roller 32A, and setting the amount (angle) by which the steering roller 35 is to be tilted, to such a value that can cancel the detected amount of the positional deviation of the intermediary transfer belt 31, which occurs with a frequency which corresponds to the rotational frequency of the transfer surface formation roller 32A.

Referring to FIG. 3, the control portion 1000 tilts the steering roller 35 by controlling the steering motor 41 based on the output of the belt edge sensor 38A, so that the intermediary transfer belt 31 remains in a preset position in terms of the widthwise direction of the recording medium passage. More specifically, the steering motor 41 is a pulse motor, and the control portion 1000 is made up of a high speed arithmetic element. Thus, the control portion 1000 controls the steering motor 41 in the direction in which the motor 41 is to be rotated, and the angle by which the motor 41 is rotated, by outputting the results of computation made based on the inputted data, in the form of electrical pulses.

A positional deviation amount computing portion 1007 samples the output data of the belt edge sensor 38A every 10 msec, and corrects the data based on the belt edge profile data. Then, it computes the amount of the positional deviation by comparing the corrected data with a target position for the belt edge.

A first controller 1001 rids the intermediary transfer belt 31 of the snaking, that is, the positional deviation of the intermediary transfer belt 31, which occurs with a low frequency, by controlling the steering motor 41 in such a manner that the gain is low relative to the amount of the positional deviation of the belt 31. One of the typical devices which may be considered as the first controller 1001 is a PID controller or the like, and corrects the intermediary transfer belt 31 in positional deviation, based on the value obtained by integrating the speed with which the intermediary transfer belt 31 is moved in the widthwise direction of the recording medium passage by the tilting and rotation of the steering belt 31.

A second controller 1003 corrects the intermediary transfer belt 31 in the positional deviation which occurs with a specific higher frequency, that is, the positional deviation attributable to the wobbling of the belt supporting roller(s), by controlling the steering motor 41 with a larger gain. More specifically, the second controller 1003 moves the intermediary transfer belt 31 toward a preset position in the direction parallel to the widthwise direction of the recording medium passage, by using the integral displacement (FIG. 4) of the intermediary transfer belt 31 and the steering roller 35 in the widthwise direction of the recording medium passage, which directly and immediately results from by the tilting of the steering roller 35.

The control portion 1000 controls the steering motor 41 based on the value obtained by simply adding the amount (angle) by which the steering roller 35 is to be controlled by the first controller 1001, and the amount (angle) by which the steering roller 35 is to be controlled by the second controller 1003. The value set by the second controller 1003 as the amount (angle) by which the steering roller 35 is to be tilted in response to a given amount of the detected positional deviation of the intermediary transfer belt 31 is immensely larger than the value set by the first controller 1001 as the amount (angle) by which the steering roller 35 is to be tilted in response to the same amount of the detected positional deviation of the intermediary transfer belt 31. However, the amount of the positional deviation of the intermediary transfer belt 31, which occurs at specific frequency, is very small, being no mote than 10 μm, and the value outputted by the second controller 1003 as the amount (angle) by which the steering roller 35 is to be tilted alternately becomes positive and negative with short internals (a high frequency). Therefore, the amount by which the intermediary transfer belt 31 is moved by the tilting of the steering roller 35 by the second controller 1003, that is, the integration of the speed with which the intermediary transfer belt 31 is moved in position by the tilting of the steering roller 35 by the second controller 1003, does not amount to a significant value.

The first controller 1001 controls the intermediary transfer belt 31 in the speed with which the intermediary transfer belt 31 laterally shifts in position, inclusive of the position deviation of the intermediary transfer belt 31 remaining after the control by the second controller 1003, in order to make the position of the intermediary transfer belt 31 in terms of its widthwise direction gradually converge to a preset point. In other words, the control by the second controller 1003 is short in interval. Therefore, carrying out the control by the second controller 1003 at the same time as the control by the first controller 1001, which is longer in intervals, does not invite instability.

<Comparative Belt Shift Control System 1>

Figure 5:
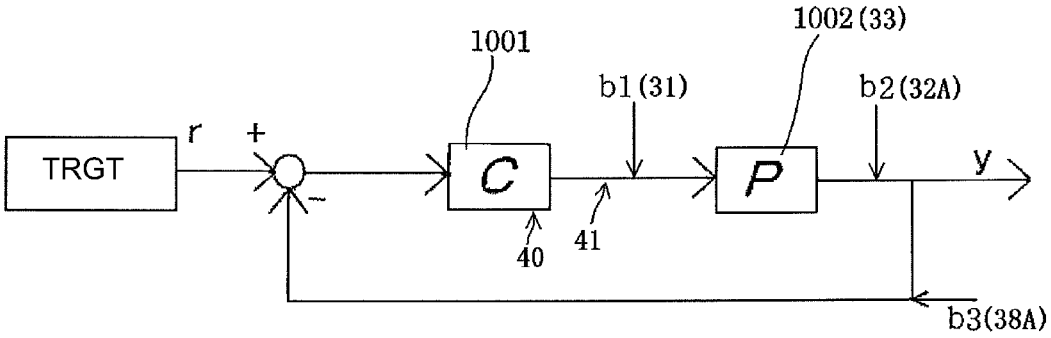
FIG. 5 is a block diagram of the first example of the comparative belt shift control systems.
Figure 6:
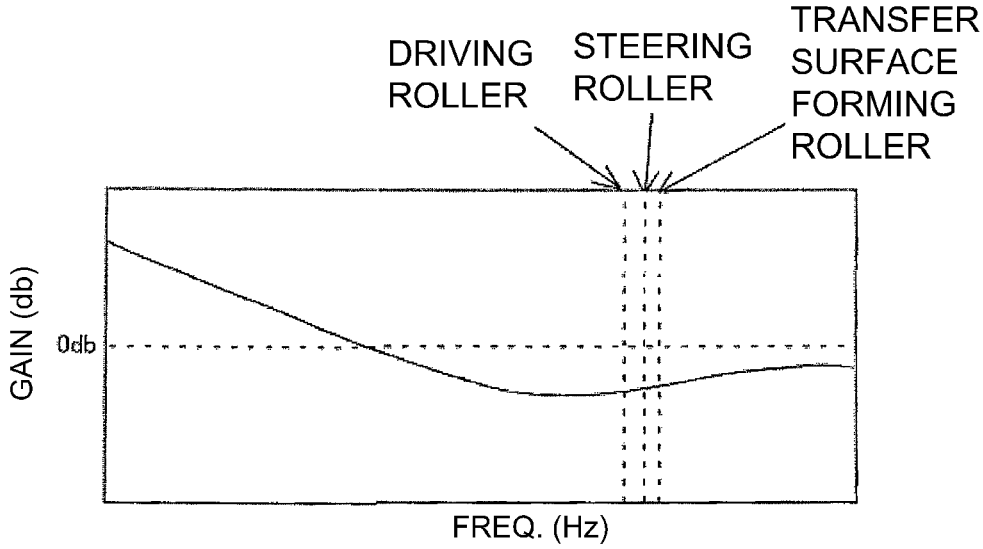
FIG. 6 is a drawing for describing the frequency characteristics of the gain of the first example of the comparative control systems.
Figure 7:
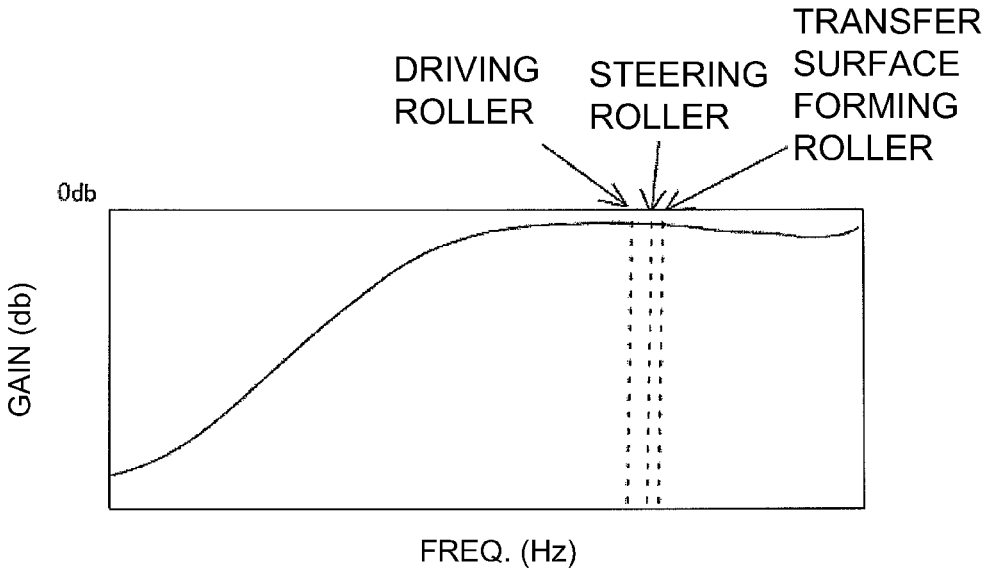
FIG. 7 is a drawing for describing the frequency characteristics of the coefficient of sensitivity to disturbance of the first example of the comparative control systems.

FIG. 5 is a block diagram of the first of the comparative belt shift control systems. FIG. 6 is a drawing for describing the frequency characteristics of the gain of the first example of comparative belt shift control system. FIG. 7 is a drawing for describing the frequency characteristics of the coefficient of sensitivity to disturbance of the first example of comparative belt shift control system.

Referring to FIG. 5, in the first comparative belt shift control system, the first controller 1001 controls an object 1002 (intermediary transfer belt 31). A disturbance b1, which occurs between the first controller 1001 and object 1002 is the mechanical play of the steering mechanism (33 in FIG. 2), for example. A disturbance b2, which occurs after the object 1002 began to move, directly affects the lateral shifting of the intermediary transfer belt 31. An example of the disturbance b2 is the positional deviation of the intermediary transfer belt 31 in the direction parallel to the widthwise direction of the recording medium passage, which is caused by the wobbling of the belt supporting roller. That is, it is one of the problems which the present invention is intended to solve. A disturbance b3 is the error in the position of the intermediary transfer belt 31 read by the belt edge sensor 38A. The typical examples of this interference b3 are electrical noises, error in the aforementioned belt edge profile, and the like.

FIG. 6 is a Bode diagram which shows the relationship between the frequency of the positional deviation of the intermediary transfer belt 31 and the gain, and shows the frequency characteristics of the shifting of the object 1002 (intermediary transfer belt 31) of control. The input is the amount (angle) by which the steering roller 35 is tilted, and the output is the amount by which the intermediary transfer belt 31 is moved by the tilting of the steering roller 35. As is evident from FIG. 6, the amount of gain in the low frequency range is greater than the amount of gain in the high frequency range. However, the gain slightly increases during the transition from the low frequency range to the high frequency range.

The reason why the amount of gain is greater in the low frequency range is that the speed with which the intermediary transfer belt 31 is made to shift in position by the tilting of the steering roller 35 is integrated. On the other hand, the slight gain which occurs on the high frequency side is attributable to the movement of the intermediary transfer belt 31 in the widthwise direction of the recording medium passage, which is caused by the tilting of the steering roller 35 with no relation to the rotation of the steering roller 35.

Shown in FIG. 7 is the characteristics of the (coefficient of sensitivity to disturbance) gain which occurs in the period between the occurrence of the disturbance b2 and output y when a PI controlling device which does not have a differentiating function is used as the first controller 1001. That is, FIG. 7 shows the relationship between the gain and the rotational frequency of the driver roller, rotational frequency of the steering roller, and rotational frequency of the transfer surface formation roller, that is, the effects of the disturbance b2 upon the output y.

Referring to FIG. 7, the higher the frequency, the closer to 0 dB the coefficient of sensitivity to disturbance. This means that the higher the frequency, the smaller the amount by which the signals resulting from the disturbance b2 attenuates in amplitude while affecting the output y. Therefore, the signals resulting from the disturbance B2 can be reduced in its effects by the first controller 1001 in such a manner that the lower the frequency, the smaller the effects.

Next, referring to FIG. 6, on the other hand, the gain characteristics of the object 1002 of control includes the belt shift caused by the twisting of the belt. Thus, the gain is greater on the high frequency side. Therefore, the coefficient of sensitivity to disturbance, which is shown in FIG. 7, is slightly low in gain on the high frequency side, is not an amount which can satisfactorily suppress the disturbance b2. That is, the first controller 1001 is too slow in response to cancel the positional deviation of the intermediary transfer belt 31, which is caused by the disturbance b2 with a frequency which corresponds to the rotational frequency of the belt supporting rotational member.

Incidentally, as one of the methods which may be considered effective to reduce the gain of the coefficient of sensitivity to disturbance, is to increase the first controller 1001 in the gain in the high frequency range. For example, it is possible to uses a PID controller as the first controller 1001 in order to increase the first controller 1001 in its differential term. However, this type of method increases the intermediary transfer belt 31 in the speed with which it laterally shifts, and therefore, the errors b3 in the reading of the belt edge sensor 38A is amplified, which makes the belt steering system unstable. Thus, a combination of control and structure which does not affect the belt edge sensor 38A in its edge reading performance is necessary.

Thus, in the following preferred embodiments of the present invention, attention was paid to the fact that the frequency of the wobbling of the belt supporting rotational member, which is the primary cause of the disturbance b2, is known. Thus, the effects of the disturbance b2 are reduced by connecting the second controller 1003, which is capable of suppressing only the disturbance b2, which is specific in frequency, in parallel to the first controller 1001.

Embodiment 1

Figure 8:
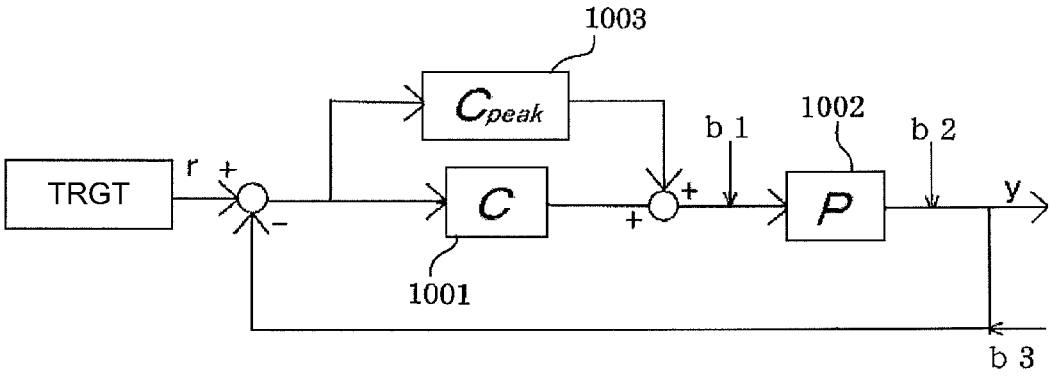
FIG. 8 is a block diagram of the belt shift control system in the first embodiment of the present invention.
Figure 9:
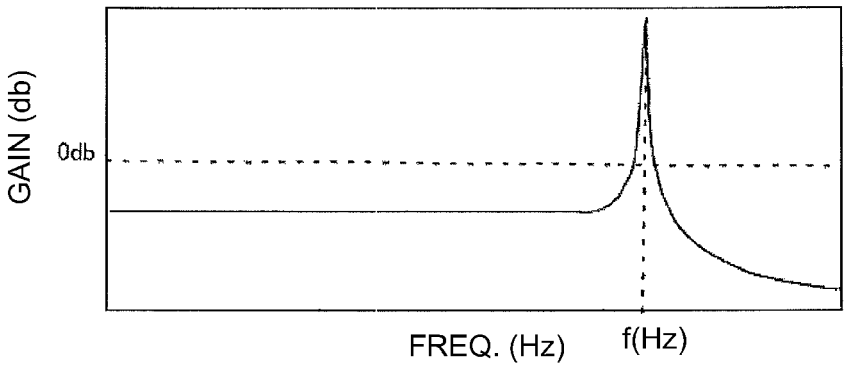
FIG. 9 is a drawing for describing the frequency characteristics of the gain of the second controller.
Figure 10:
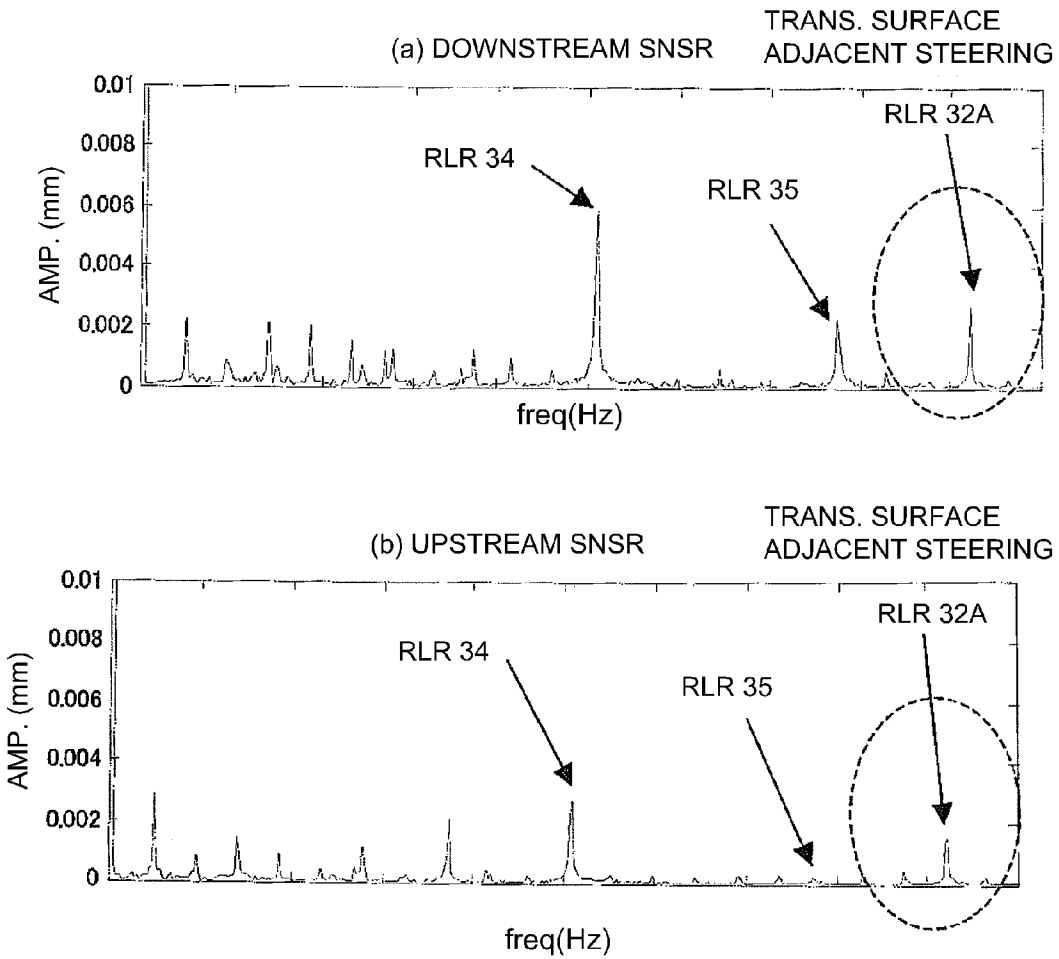
FIG. 10 is a drawing for describing the results of the frequency analysis of the belt shift amount detected by the first example of the comparative belt shift control systems.
Figure 11:
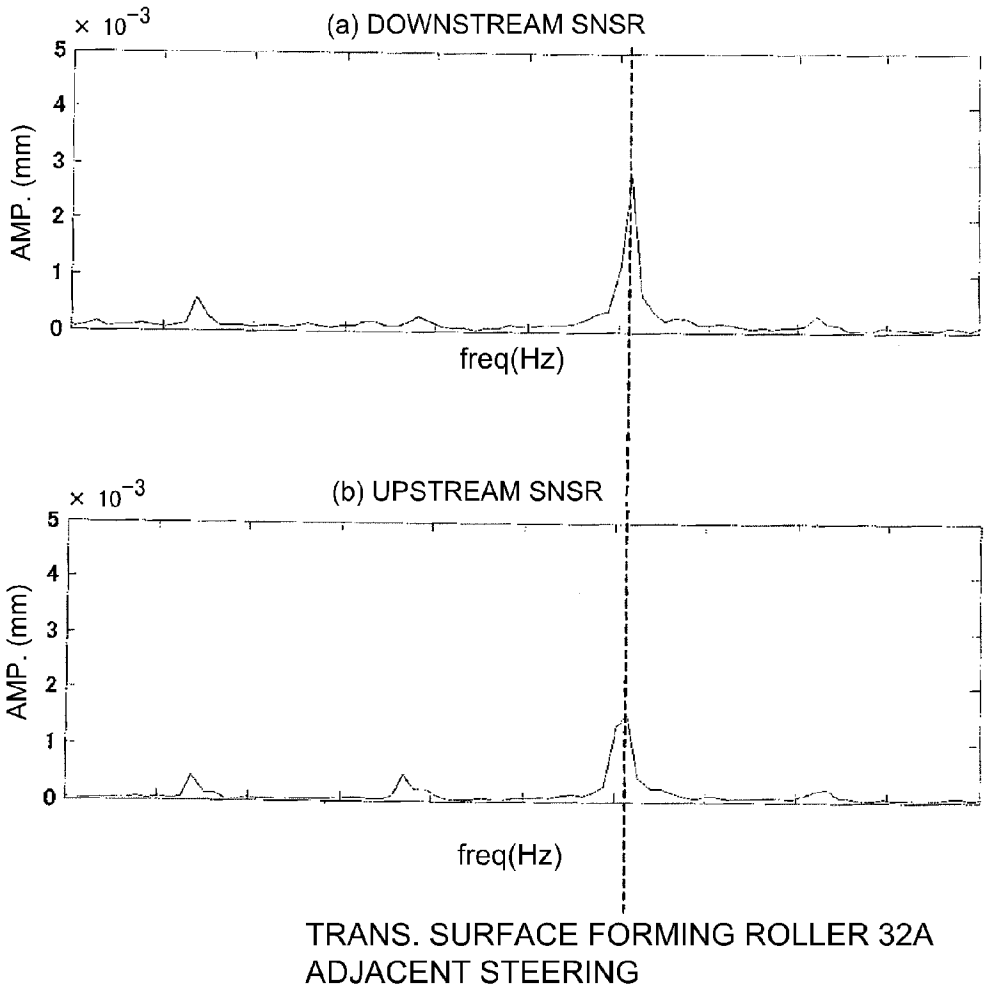
FIG. 11 is an enlargement of a portion of the drawing (FIG. 10) for describing the results of the frequency analysis of the first example of the comparative belt shift control systems.
Figure 12:
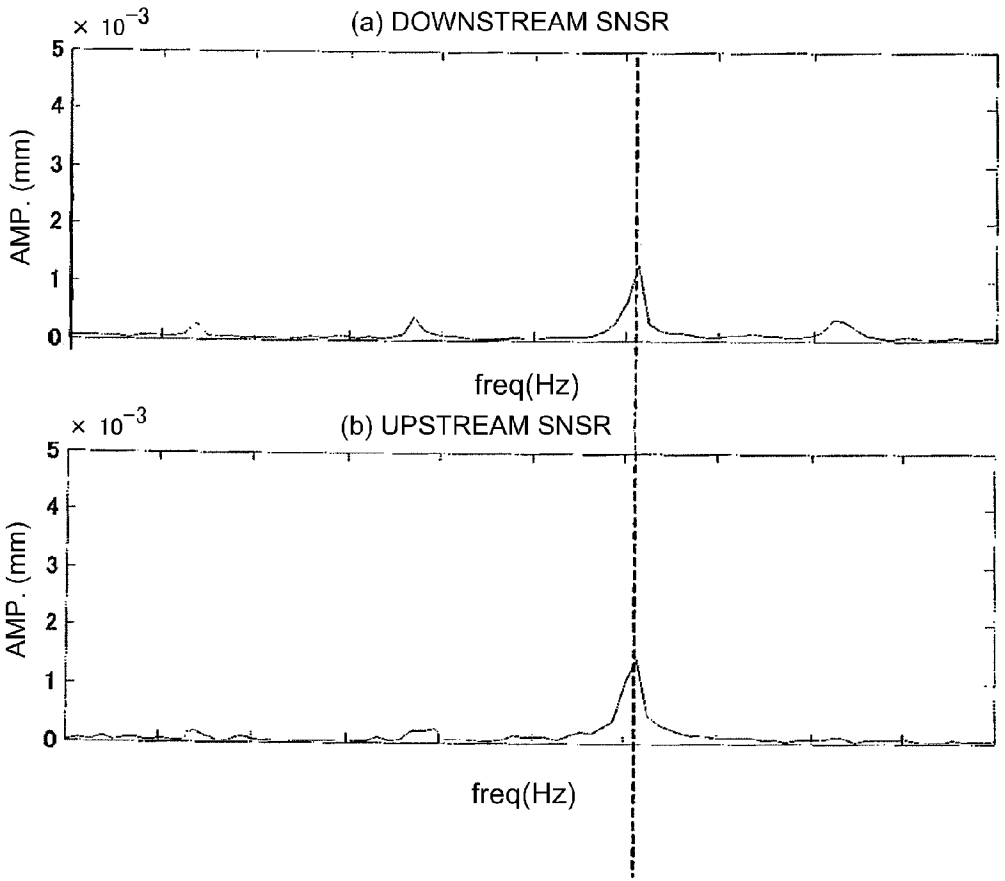
FIG. 12 is a drawing for describing the results of the frequency analysis of the belt shift amount detected by the belt shift control system in the first preferred embodiment.

FIG. 8 is a block diagram of the belt shift control system in the first preferred embodiment of the present invention. FIG. 9 is a drawing that depicts the relationship between the gain and frequency of the second controller 1003. FIGS. 10(*a*) and 10(*b*) are graphs which show the results of analysis of the relationship between the amount of belt shift measured in a belt shift control carried out by the first comparative steering system (belt unit). FIGS. 11(*a*) and 11(*b*) are enlargements of the portions of the graphs in FIGS. 10(*a*) and 10(*b*) surrounds by elongated dotted circles, respectively. FIGS. 12(*a*) and 12(*b*) are graphs for describing the results of the analysis of the relationship between the amount of the belt shift measured during the belt shift control in the first preferred embodiment, and frequency.

Referring to FIG. 8 along FIG. 3, in the first preferred embodiment, attention was paid to the peak of the disturbance, the frequency of which corresponds to the rotational frequency of the transfer surface formation roller 32A. That is, the primary object is to eliminate the effects of this disturbance. More specifically, the second controller 1003 is used to minimize the color deviation resulting from the image forming apparatus 1 attributable to the wobbling (nutation) of the transfer surface formation roller 32A, which is in the adjacencies of the steering roller 35. In order to minimize the effects of the disturbacne b2 by a feedback process, the second controller 1003 is connected in parallel to the first controller 1001.

Next, referring to FIG. 9, the first controller 1001 performs the computation for the normal PI control, based the following mathematical equation:

$$C=Kp+Ki\times(1/(Z-1))$$

Here, Kp stands for a proportional gain, and Ki stands for an integration gain. Z means "advances to the next sampling step". C stands for a coefficient of transmission for a discrete digital PI control device.

On the other hand, the second controller 1003 functions as a filter characterized in that it is greater in gain in a specific frequency range in a Bode diagram. Provided that the rotational frequency of the transfer surface formation roller 32A is f (Hz), and the length of sampling time is t see, if the gain of the second controller 1003 peaks with the same frequency as f(HZ), the coefficient of transmission for a filter whose gain is K can be expressed in the form of the following equation:

$$Cpeak = \frac{K}{z^2 - 2\cdot\cos(2\cdot\pi\cdot f\cdot t)\cdot z + 1} \quad (1)$$

The denominator of the Equation (1) is a formula for extracting the amplitude of the disturbance which is f in frequency, from the amplitudes obtained during three consecutive sampling periods.

Incidentally, the steering system controller may be provided with multiple second controllers 1003, which are the same in frequency as the multiple belt supporting rollers, one for one, and are connected in parallel to the first controller 1001, so that the cyclic disturbance, that is, the effects of the wobbling (nutation) of each of the multiple belt supporting rollers, can be individually cancelled (minimized).

Next, referring to FIG. 1, the rotational frequency of the transfer surface formation roller 32A of the image forming apparatus 1 which is the object to be controlled by the second controller 1003 was determined using the following method.

First, the intermediary transfer belt 31 of the image forming apparatus 1 is rotated while being controlled in its lateral shift by the first example of comparative belt shift control method shown in FIG. 5. That is, the amount (angle) by which the steering roller 35 is to be tilted is controlled while sending the output of the belt edge sensor 38A through a feedback loop. The amount of the belt shift as measured with the use of both the belt edge sensors 38B and 38A, although the preferred embodiments of the present invention are compatible with only a belt unit which has only a single steering roller (35).

Then, the data, that is, the amounts of belt shift, obtained by the belt edge sensors 38B and 38A are subjected to frequency analysis. That is, the characteristics of the belt unit in terms of the relationship between the amplitude of the belt shift at the belt edge sensors 38B and 38A and the frequency are obtained.

Referring to FIG. 10(*a*), the belt shift data obtained by the belt edge sensor 38A, which is the downstream sensor, are: the rotational frequency of the driver roller 34; the rotational frequency of the steering roller 35; and the rotational frequency of the transfer surface formation roller 32A, which corresponds to the frequency of the peaking of the disturbance b2, which is attributable to the belt supporting rotational member. As a result, it was discovered that the effects of the disturbance, the peak of which corresponds to the rotational frequency of the transfer surface formation roller 32A, cannot be satisfactorily eliminated by the first controller 1001 alone.

Next, referring to FIG. 10(*b*), in the case of the belt shift data obtained by the belt edge sensor 38B, that is, the upstream sensor, the effects of the disturbance, is less in terms of its peak which corresponds in frequency to the rotational frequency of the steering roller 35. However, the peak of the effects of the disturbance, which corresponds in frequency to the rotational frequency of the driver roller 34 and transfer surface formation roller 32A, were detected as the disturbance b2.

FIG. 11 is an enlarged view of the portion of FIG. 10, which is surrounded by a dotted line, and shows the characteristics of the disturbance in terms of the amplitude of the belt shift. Referring to FIG. 11(*a*), the belt edge shift detected by the belt edge sensor 38A, that is, the downstream sensor, is relatively large in amplitude of the shift attributable to the wobbling (nutation) of the transfer surface formation roller 32A. On the other hand, the belt edge shift detected by the belt edge sensor 38B, that is, the upstream sensor, is relatively small in amplitude of the shift attributable to the wobbling (nutation) of the transfer surface formation roller 32A as shown in FIG. 11(*b*).

Next, referring to FIG. 8, the gain was adjusted by placing the second controller 1003 which has the transfer function characteristics shown by the mathematical equation (1) given above, is connected in parallel to the first controller 1001. Then, the amount by which the steering roller 35 is to be tilted was controlled while feeding the output of the belt edge sensor 38A to the second controller 1003 through the feedback loop. While the control is carried out, the data regarding the belt shift were measured with the belt edge sensors 38B and 38A.

Then, the data, that is, the amounts of belt shift, obtained by the belt edge sensors 38B and 38A was subjected to frequency analysis. That is, the characteristics of the belt unit in terms of the relationship between the amplitude of the belt shift at the belt edge sensors 38B and 38A, and frequency, were obtained.

Referring to FIG. 12(*a*), the belt shift data obtained by the belt edge sensor 38A, which is the downstream sensor, are: the rotational frequency of the driver roller 34; the rotational frequency of the steering roller 35; and the rotational frequency of the transfer surface formation roller 32A, which corresponds to the frequency of the peaking of the disturbance b2, which is attributable to the belt supporting rotational member, as they were in the case of the first example of comparative control. As a result, it was discovered that in the case of the control in the first preferred embodiment, the effects of the disturbance, the frequency of the peak of which corresponds to the rotational frequency of the transfer surface formation roller 32A, were satisfactorily suppressed because of the addition of the second controller 1003.

As is evident from the comparison between FIGS. 11 and 12, the control in the first embodiment significantly reduced the amount of the difference between the amplitude of the belt shift detected by the belt edge sensor 38B and that by the belt edge sensor 38A, compared to the first example of comparative control.

The reason for the above described results is as follows: the amount of the direct widthwise movement of the intermediary transfer belt 31 which occurs as the steering roller 35 is tilted by a preset amount (angle) is greater in the adjacencies of the steering roller 35; the farther from the steering roller 35 the smaller the amount of the movement. Therefore, the amount by which the intermediary transfer belt 31 can be reduced in the amount of its positional deviation in the widthwise direction of the recording medium passage, at the location of the belt edge sensor 38A, that is, the downstream sensor, which is in the adjacencies of the steering roller 35, is greater than at the location of the belt edge sensor 38B, that is, the upstream sensor. That is, the control can be increased in effect by operating the second controller 1003 in a manner to rid the intermediary transfer belt 31 of the positional deviation which occurs in the adjacencies of the steering roller 35, or the vibrant positional deviation, the frequency of which corresponds to the rotational frequency of the steering roller 35.

Further, if the interval between the adjacent two image forming portions among the image forming portions 20Y, 20M, 20C, and 20K equals a multiple of the rotational frequency of the transfer surface formation roller 32A, the image forming apparatus can be further reduced in the amount of color deviation even if the first transfer surface 53 periodically shifts in parallel to the moving direction of the intermediary transfer belt 31. That is, in a case where multiple image bearing members are aligned in the direction parallel to the moving direction of a belt (31) and in contact with the belt (31), it is desired that the interval between the adjacent two of the multiple image bearing members equals to a multiple of the circumference of the first belt supporting roller (32A).

In the first embodiment, the second controlling means (1003) controls the steering roller 35 using the amount by which the steering roller 35 and belt are move together by the tilting of the steering roller 35 in the widthwise direction of the recording medium passage, in such a manner that the belt is moved to a preset position. The first controller 1001 controls the steering roller 35 to reduce the amount by which the intermediary transfer belt 31 is shifted in the widthwise direction of the recording medium passage, relative to the steering roller 35 as the intermediary transfer belt 31 is circularly moved. The second controller 1003 controls the steering roller 35 to reduce the amount by which the intermediary transfer belt 31 is shifted in the widthwise direction of the recording medium passage, by the wobbling (nutation) of the transfer surface formation roller 32A, which occurs as the roller 32A rotates while supporting the intermediary transfer belt 31.

In the first embodiment, the second controller 1003 functions as a filter, the gain of which peaks with a specific frequency, and is parallel in connection to the first controller 1001. The belt steering system may be provided with multiple second controllers 1003, which function as filters, the gain of which peaks at specific frequency, which correspond to the rotational frequency of multiple belt supporting rollers, one for one, and are connected in parallel to the first controller 1001. With this arrangement, not only the positional deviation of the intermediary transfer belt 31, which is attributable to the wobbling of the transfer surface formation roller 32A, but also, the positional deviation of the intermediary transfer belt 31, which is attributable to the wobbling of the steering roller 35, driver roller 34, and/or belt backing roller 36, can also be eliminated (minimized).

<Comparative Belt Shift Control System 2>

Figure 13:
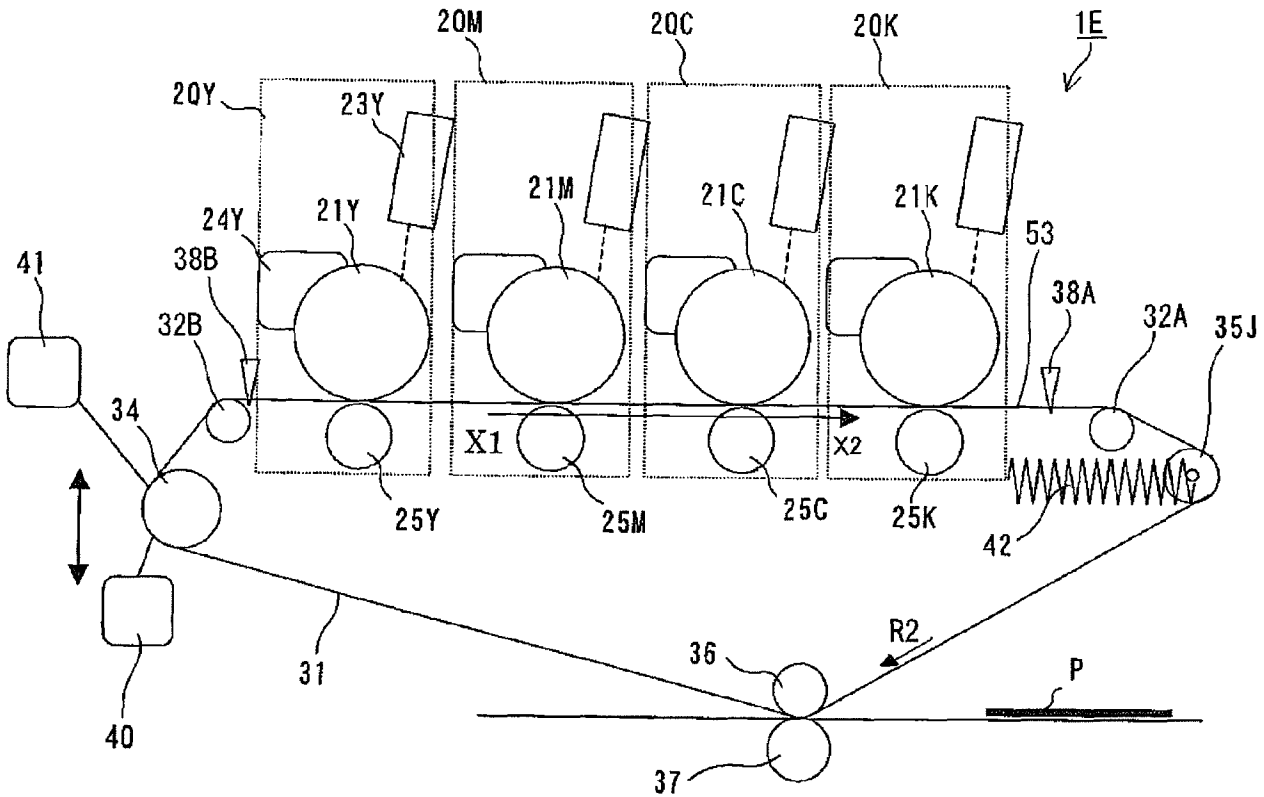
FIG. 13 is a drawing for describing the structure of the second example of the comparative image forming apparatuses.
Figure 14:
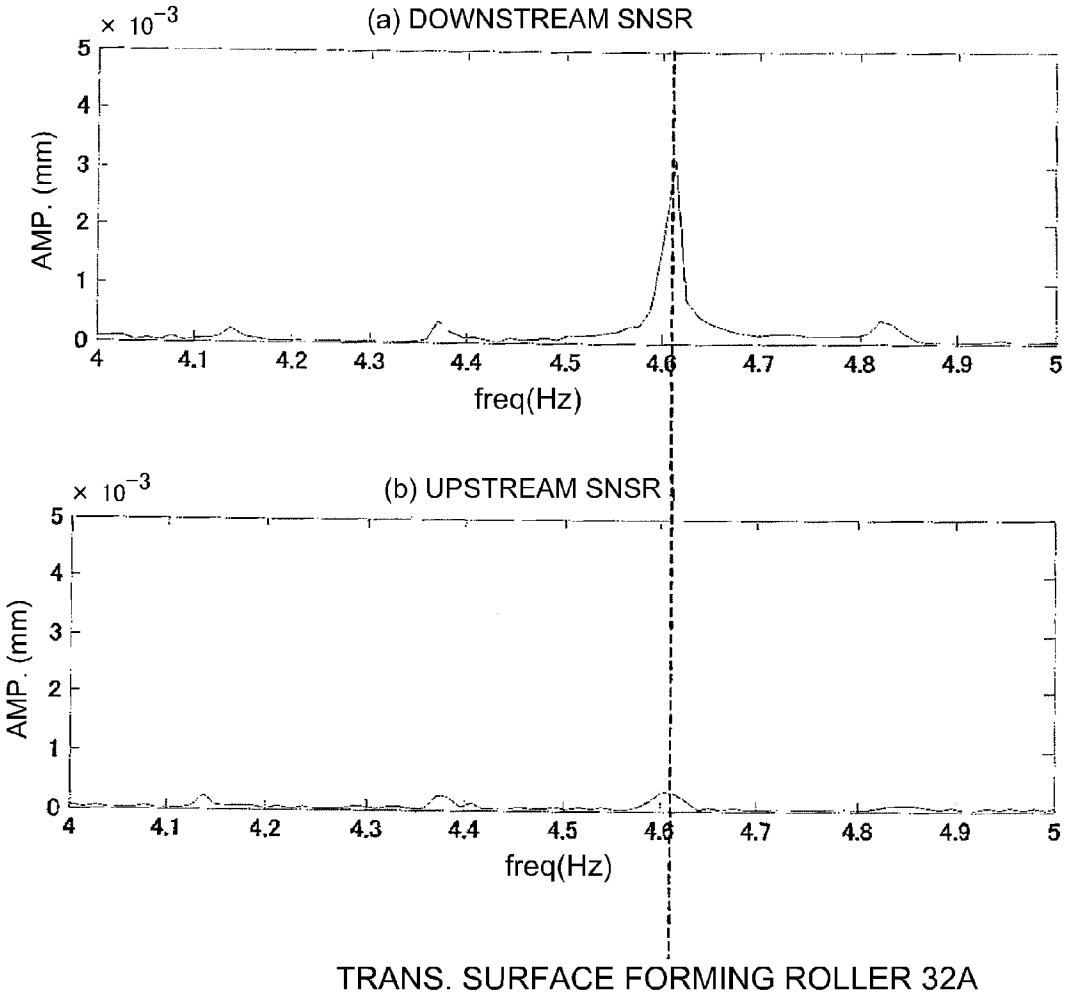
FIG. 14 is a drawing for describing the frequency analysis of the belt shift amount measured by the second example of the comparative belt control systems.

FIG. 13 is a drawing for describing the structure of the second example of comparative image forming apparatus. FIG. 14 is a drawing for describing the results of the analysis of the relationship between the amount of belt shift of the second comparative example of image forming apparatus, and the frequency.

Referring to FIG. 13, the structure of an image forming apparatus 1E, the second example of comparative image forming apparatus, is such that its driving roller 34 doubles as its steering roller. It is also such that its tension roller 35J cannot be tilted, and the driving roller 34 can be steered by a steering mechanism similar to the steering mechanism shown in FIG. 2. As for the belt shift control of this apparatus, its intermediary transfer belt 31 is made to converge to a preset position in terms of the widthwise direction of the recording medium passage, by tilting the driver roller 34 by controlling the steering motor 41 based on the output of the belt edge sensor 38B, that is, the upstream sensor.

Referring to FIG. 8, the output of the upstream belt edge sensor 38B is fed to the first and second controllers 1001 and 1003 through a feedback loop. More concretely, by designing the image forming apparatus 1E as described above, it was studied whether or not an image forming apparatus can be prevented from outputting images which suffer from the color deviation attributable to the disturbance (positional deviation of the intermediary transfer belt 31), the frequency of which corresponds to the rotational frequency of the transfer surface formation roller 32A, which is on the opposite side of the first transfer surface 53 from the driver roller 34. The results of the study are as follows: The application of the belt shift control in the first embodiment to the image forming apparatus 1E, that is, the second comparative example of image forming apparatus, the belt unit of which has only one steering mechanism, cannot prevent the apparatus 1E from outputting images which suffer from the color deviation.

The image forming apparatus 1E detects the position of the intermediary transfer belt 31 with the use of the upstream belt edge sensor 38B, and makes the intermediary transfer belt 31 converge to a target position (minimize in snaking), by setting the amount (angle) by which the steering roller 35 is to be tilted, based on the amount of positional deviation of the intermediary transfer belt 31 from the target position, in terms of the widthwise direction of the recording medium passage.

Referring again to FIG. 8, the intermediary transfer belt 31 is made to converge to the target position, by controlling the amount (angle) by which the driver roller 34 is to be tilted, while feeding the output of the upstream belt edge sensor 38B back to the first controller 1001 through a feedback loop. Further, the disturbance b2, the frequency of occurrence of which corresponds to the rotational frequency of the transfer surface formation roller 32A, is eliminated by controlling the amount (angle) by which the driver roller 34 is to be tilted, while feeding the output of the upstream belt edge sensor 38B back to the second controller 1003 through the feedback loop. Referring to FIG. 9, the frequency characteristics of the second controller 1003 was made to correspond to the rotational frequency of the transfer surface formation roller 32A.

The belt shift data was measured by the belt edge sensors 38B and 38A. Then, the belt shift data obtained by the upstream belt edge sensor 38A and downstream belt edge sensor 38B were analyzed regarding the relationship between the amount of the belt shift and the frequency to obtain the characteristics, in amplitude, of the belt shift measured at the locations of the belt edge sensors 38B and 38A at each frequency. FIG. 14 is an enlargement of the portion of FIG. 10, where the external disturbance which peaks with a frequency which corresponds to the rotational frequency of the transfer surface formation roller 32A.

Referring to FIG. 14(*b*), the belt deviation which occurs at the position of the upstream belt edge sensor 38B with a frequency which corresponds to the rotational frequency of the transfer surface formation roller 32B was substantially smaller in amplitude than that of the first comparative example of image forming apparatus (only controller 101 was used for control) shown in FIG. 11. However, the positional deviation of the intermediary transfer belt 31, the frequency of which corresponds to the rotational frequency of the transfer surface formation roller 32B, hardly reduced at the position of the downstream belt edge sensor 38A.

As is evident from the comparison between FIGS. 12 and 14, the addition of the second controller 1003 to the second example of comparative image forming apparatus reduces the apparatus in the amplitude of the positional deviation of the intermediary transfer belt 31 which occurs at the upstream edge sensor 38B which is in the adjacencies of the steering roller 35, but, does not reduce it at the downstream edge sensor 38A. That is, unlike the second embodiment, the cyclical shift of the first transfer surface 53 is not parallel to recording medium passage. Compared to the image forming apparatus in the first embodiment, the second example of comparative image forming apparatus 1E is greater in the difference between the amount of the positional deviation of the intermediary transfer belt 31 at the upstream edge sensor 38B and that at the downstream belt edge sensor 38A, and also, is likely to be worse in image quality in terms of color deviation.

Thus, it is desired that the second controller 1003 is used to control the positional deviation of the intermediary transfer belt 31, which occurs with a frequency which corresponds to the rotational frequency of the transfer surface formation roller 32B, instead of that which occurs with a frequency which corresponds to the rotational frequency of the transfer surface formation roller 32A.

Therefore, a belt unit having only one steering roller (35) needs to be provided with an additional controller, that is, the second controller 1003, which functions as a filter, the frequency of which matches the rotational frequency of the belt supporting rotational member which is in the adjacencies of the belt supporting rotational member, and can be tilted for steering the belt, as stated in the description of the first embodiment. By feeding the output of the belt position detecting means positioned in the adjacencies of the belt supporting rotational member which can be tilted to steer the belt, back to such a controller as the above described second controller 1003, it is possible to most effectively reduce an image forming apparatus in the disturbance peak in the positional deviation of its belt, which is attributable to the belt supporting rotational member, and therefore, in color deviation.

In the first embodiment, attention was paid to the peak of the disturbance, the frequency of the occurrence of which corresponds to the transfer surface formation roller 32A, which is in the adjacencies of the steering roller 35. However, the present invention is also applicable to the disturbance, which is caused by the steering roller 35, and/or the other belt supporting rotational members, and peaks with a frequency which corresponds to the rotational frequency of the rollers.

In other words, the belt shift control in the first embodiment of the present invention ensures that an image forming apparatus is reduced in the amount by which its belt vibrantly deviates in the widthwise direction of the recording medium passage, with a frequency which corresponds to the rotational frequency of each of the multiple belt supporting rotational members. In other words, it ensures that one of the primary reasons why an image which suffers from color deviation is formed on the intermediary transfer belt 31 is eliminated. That is, it can reduce an image forming apparatus in color deviation.

Embodiment 2

Figure 15:
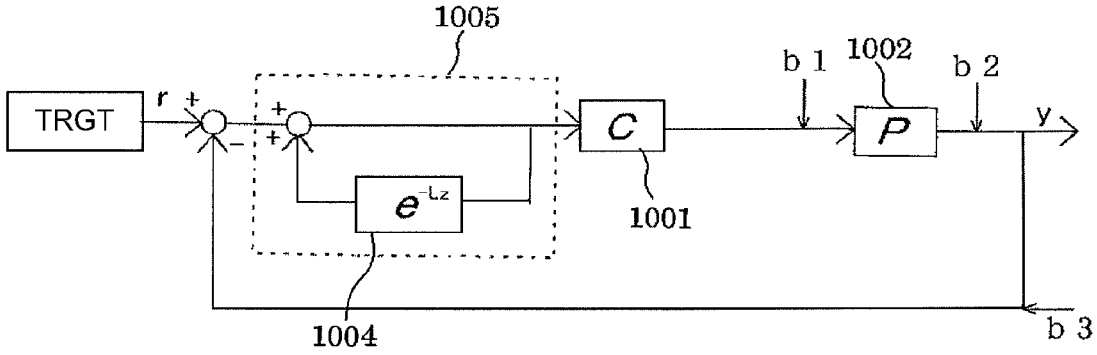
FIG. 15 is a block diagram of the belt shift control in the second embodiment of the present invention.

FIG. 15 is a block diagram of the belt shift control system in the second of the preferred embodiment of the present invention. The structure for a second controller (1003) which controls the steering motor 41 with a large gain to minimize the image forming apparatus only in the positional deviation of its belt, which occurs with short and specific intervals, does not need to be limited to the structure for the second controller 1003 in the first embodiment. That is, the structure of a controlling means capable of generating output with a large gain in response to the positional deviation of a belt, the frequency of the occurrence of which corresponds to the rotational frequency of the belt supporting rotational member, does not need to be limited to the one shown in FIG. 8. In the second preferred embodiment, the structure for the controlling means, which is shown in FIG. 8, is replaced with a different one.

Referring to FIG. 15, in the second embodiment, a frequency signal generator 1005, which is capable of generating signals with any frequency, is serially connected to the first controller 1001. The frequency signal generator 1005 contains a delay time generation compensator 1004 which performs positive feedback. That is, the frequency signal generator 1005 can generate signals, the interval of which is L, by adding the previous signal, which is a length L of time earlier in generation, to the value of the present one. Incidentally, a low-pass filter for eliminating high frequency noises may be placed behind the delay time generation compensator 1004.

That is, in the second embodiment, the delay time generation compensator 1004 is employed as the second controller to cancel the disturbance b2, which occurs with a frequency L after the object 1002 of control is controlled. The second controlling means is structured so that a repetitive control compensator which generates frequency signals with specific intervals is serially connected to the first controlling means.

Embodiment 3

Figure 16:
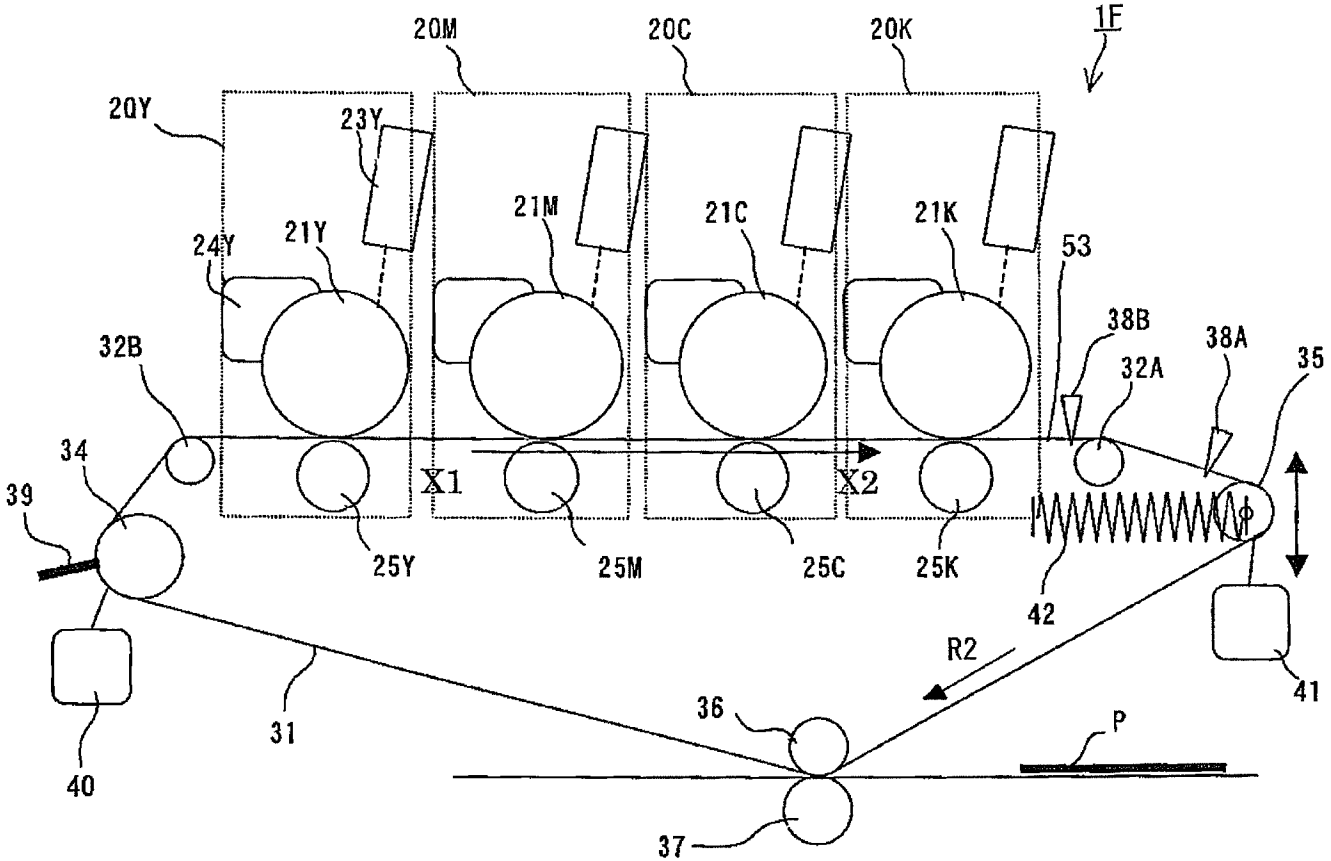
FIG. 16 is a drawing for describing the structure of the image forming apparatus in the third embodiment of the present invention.
Figure 17:
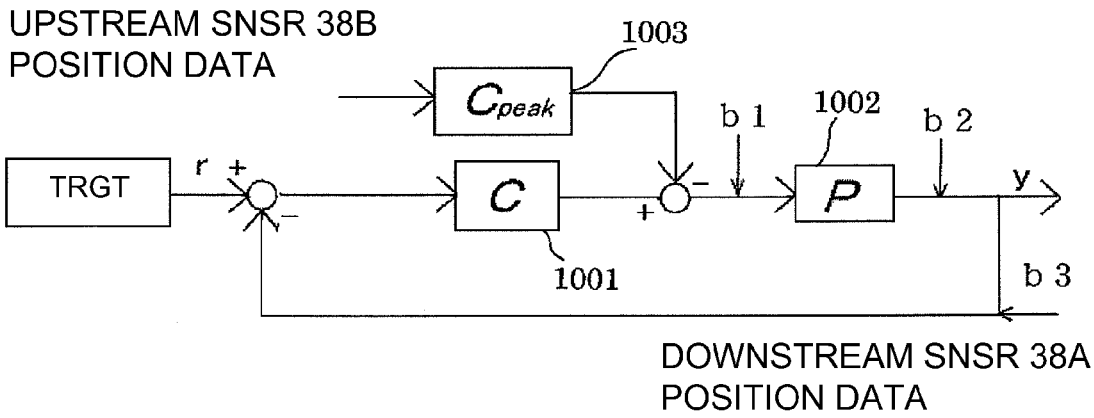
FIG. 17 is a block diagram of the belt shift control in the third embodiment of the present invention.

FIG. 16 is a schematic drawing for describing the image forming apparatus in the third of the preferred embodiments of the present invention. FIG. 17 is a block diagram of the belt shift control system in the third of the preferred embodiments.

In the first preferred embodiment, the output of the belt edge sensor 38A is fed to both the first and second controllers 1001 and 1003 through a feedback loop. In the third preferred embodiment, however, the first controller 1001 is fed with the output of the belt edge sensor 38A through the feedback loop, and the second controller is fed with the output of the belt edge sensor 38B through the feedback loop. That is, the first controller 1001, which is for minimizing the snaking (slow oscillatory movement of belt in widthwise direction of recording medium passage), is fed with the output of the belt edge sensor 38A, which is in the adjacencies of the steering roller 35, through the feedback loop.

In comparison, the second controller 1003 is fed, through a feedback loop, with the output of the belt edge sensor 38B, which is in the adjacency of the transfer surface formation roller 32A and detects the position of one of the lateral edges of the first transfer surface 53. This arrangement corrects (minimizes) the image forming apparatus in the positional deviation of the first transfer surface 53 in the widthwise direction of the recording medium passage, which occurs at the same frequency as the rotational frequency of the transfer surface formation roller 32A.

Referring to FIG. 16, the image forming apparatus 1F, that is, the image forming apparatus in the third preferred embodiment of the present invention, is provided with belt edge sensors 38B and 38A, both of which are on the downstream side of the first transfer surface 53. The belt edge sensor 38B, which is on the upstream side of the belt edge sensor 38A, is placed in the adjacencies of the upstream edge of the first transfer surface 53, which is in the adjacencies of the transfer surface formation roller 32A, whereas the belt edge sensor 38A, which is on the downstream side of the belt edge sensor 38B, is positioned closer to the steering roller 35 than to the transfer surface formation roller 32A.

Next, referring to FIG. 17, the first controller 1001, the primary job of which is to make the intermediary transfer belt 31 to converge to a preset position in terms of the widthwise direction of the recording medium passage, controls the belt steering system based on the belt position data obtained by the belt edge sensor 38A, which is in the adjacencies of the steering roller 35, whereas the second controller 1003 is fed with the belt position data obtained by the belt edge sensor 38B, which is on the upstream side of the belt edge sensor 38A.

Further, signals obtained by changing the output signals of the second controller 1003 by 180 degrees in phase are added to the output signals of the first controller 1001. Then, the combination is used to control the object 1002 of control.

One of the characteristic features of the third preferred embodiment is that the first controller 1001 is fed with the output of the downstream belt edge sensor 38B, for the following reason. That is, the belt steering system structured so that the upstream belt edge sensor 38B, which is farther from the steering roller 35 than the downstream belt edge sensor 38A, is used to set a target valve for the amount (angle) by which the first controller 1001 tilts the steering roller 35, is slow in response in controlling the object 1001 of control, being therefore unreliable in making the intermediary transfer belt 31 to converge to a preset position.

The sensor, the output of which is fed to the second controller 1003 is desired to be in the adjacencies of the roller which causes the vibrant (oscillatory) disturbance, that is, the target of control. The reason therefor is that positioning the edge sensor 38 a substantial distance away from the roller which causes the vibrant (oscillatory) disturbance, creates a substantial amount of delay between the occurrence of the disturbance and the reading of the effect of the disturbance, and this delay is likely to make it impossible for the second controller 1003 to satisfactorily reduce the intermediary transfer belt 31 in the amount of positional deviation.

Since the belt steering system in this embodiment is structured as described above, the second controller 1003 is fed with the belt shift data obtained by the sensor which is in the adjacencies of the roller which is responsible for the disturbance. In other words, the belt shift controller is provided with more precise information (data) regarding the phase of the rotational frequency of the roller, and therefore, can prevent the image forming apparatus from suffering from the positional deviation of its intermediary transfer belt (31), attributable to the cyclical disturbance, and therefore, from outputting images suffering from the color deviation attributable to the cyclical and oscillatory movement of the intermediary transfer belt in the widthwise direction of the recording medium passage. Further, the data obtained by the downstream belt edge sensor 38A, which is in the adjacencies of the steering roller 35 are used by the first controller 1001 to make the belt to converge to a target position. Therefore, the belt steering system in this embodiment is significantly more stable in terms of the control for making the belt to converge to a preset position in terms of the widthwise direction of the recording medium passage.

Also in the third preferred embodiment, the belt steering system is provided with two belt position detecting means which are positioned at two different positions, one for one, in terms of the belt movement direction. Further, the belt position data obtained by one of the two sensors are inputted into the first controlling means, and the data obtained by the other sensor are inputted into the second controlling means. Moreover, the first controlling means is fed with the data obtained by the detecting means which is closer to the steering roller.

Embodiment 4

In the first to third preferred embodiments of the present invention described above, the steering roller was on the upstream or downstream side of the area in which the belt contacts the image bearing members. The present invention, however, is also applicable to an image forming apparatus (belt steering system) having two steering rollers which are on both the upstream and downstream sides of the area in which the belt contacts the image bearing members, one for one. Japanese Laid-open Patent Application 2000-233843 discloses an image forming apparatus which has first and second steering rollers which are positioned on the inward side of the loop which the intermediary transfer belt forms, in order to correct the image forming apparatus in the skewing of the intermediary transfer belt relative to the rotational direction of the belt.

Referring to FIG. 1, the first steering roller (34) steers the belt in such a manner that the belt is corrected in its position at the upstream belt edge sensor (38B), whereas the second steering roller (35) steers the belt in such a manner that the belt is corrected in position in its position at the downstream belt edge sensor (38A).

Figure 18:
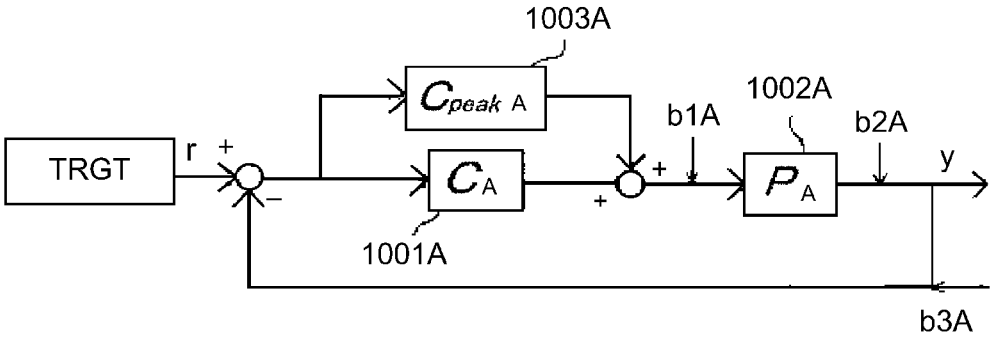
FIG. 18 is a block diagram of the belt shift control in the fourth embodiment of the present invention.
Figure 18:
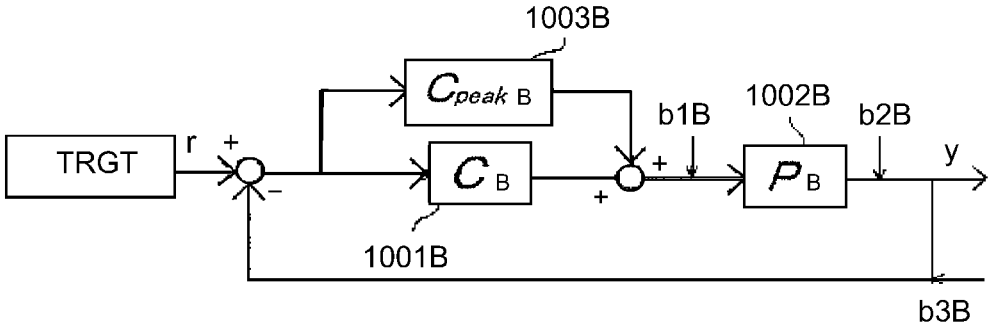

In other words, the belt steering system in this embodiment is of the so-called double steering type. FIG. 18 is a block diagram of the belt shift control sequence in this embodiment.

First, referring to FIG. 18(*a*), the downstream belt steering system has a second controller 1003A. Next, referring to FIG. 18(*b*), the upstream belt steering system has a second controller 1003B, which is different in structure from the second controller 1003A.

Also in this embodiment, in the belt shift data obtained by the downstream bolt edge sensor 38A, the peaks of the disturbance, the frequency of the occurrence of which corresponds to the rotational frequency of the driver roller 34 which doubles as the first steering roller, the rotational frequency of the second steering roller 35, and the rotational frequency of the transfer surface formation roller 32A, were detected as the disturbance b2A attributable to the belt supporting rotational members, as in the case of the first embodiment, as shown in FIG. 10(*a*).

Further, in the belt shift data obtained by the upstream belt edge sensor 38B, the peaks of the disturbance, the frequency or the occurrence of which corresponds to the rotational frequency of the driver roller 34 which doubles as the first steering roller and the rotational frequency of the transfer surface formation roller 32A, were detected by the disturbance b2B attributable to the belt supporting rotational members.

The amount of the positional deviation of the belt, which is for computing the amount by which the first steering roller (35) is to be tilted, is calculated from the output of the first detecting means (38A), which is in the adjacencies of the first belt supporting rotational member (38A). The amount of the positional deviation of the belt, which is for computing the amount by which the second steering roller (34) is to be tilted, is calculated from the output of the second detecting means (38B), which is in the adjacencies of the second belt supporting rotational member (34). The reason for this setup is the same as the reason given in the description of the third embodiment.

In the case of a belt steering system of the double-steering type such as the above described one in this embodiment, the selection of the frequency of the peak of the disturbance detected by the upstream belt edge sensor 38B does not need to be a specific one. More concretely, the rotational frequency of the transfer surface formation roller 32A which is farther from the upstream steering roller 38B than the transfer surface formation roller 32B, may be selected. However, the belt steering system in this embodiment, which removes the component of the belt deviation, which is attributable to the roller with a greater distance from the steering roller, makes the image forming apparatus worse in color deviation, for the reason given in the description of the second example of the comparative belt steering system (image forming apparatus).

Therefore, one of the characteristic features of this embodiment is that the belt steering system is structured so that the second controller 1003A, that is, the downstream steering system controller, is used also to rid the belt of the vibrant positional deviation in the widthwise direction of the recording medium passage, which is attributable to the transfer surface formation roller 32A.

That is, since the belt is rid of the vibrant position deviation in the widthwise direction of the recording medium passage, which is attributable to the transfer surface formation roller 32A, on both the upstream and downstream sides of the first transfer surface 53, the entirety of the first transfer surface 53 is rid of the vibrant positional deviation in the widthwise direction of the recording medium passage, which is attributable to the transfer surface formation roller 32A. Therefore, the image forming apparatus improves in image quality in terms of color deviation.

Further, although in this embodiment described above, the present invention was described regarding the vibrant positional deviation of the belt, the frequency of which corresponds to the rotational frequency of the transfer surface formation roller 32A, the present invention is also applicable to the downstream steering roller 38A, upstream steering roller 38B, and any of the rollers which are the structural components of a belt unit other than the belt unit in this embodiment.

Further, multiple filters 1003A, 1003B . . . , the frequency of peaking of the gain of which corresponds to those of the rotational frequency of multiple belt supporting rotational members, one for one, may all be connected in parallel to the first controlling means.

Further, in the first to fourth preferred embodiments of the present invention described above, the belt was the intermediary transfer belt of a copying machine. However, the present invention is also applicable to a belt unit other than the intermediary transfer belt of a copying machine. For example, the present invention is also applicable to the belt steering system of an image forming apparatus structured so that a toner image is directly transferred from an image bearing member onto a sheet of recording medium which is being conveyed by a recording medium conveying member, and the belt steering system of an image forming apparatus structured so that an image is formed by liquid ink droplet ejected from an inkjet head, on recording medium which is being conveyed by a belt.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 047891/2010 filed Mar. 4, 2010 which is hereby incorporated by reference.

What is claimed is:

1. An image forming apparatus comprising:

a plurality of image bearing members;

a rotatable belt member configured to carry a toner image transferred from said image bearing members or configured to carry a recording material carrying a toner image transferred from said image bearing members;

a plurality of rotatable supporting rollers, configured to stretch said belt member, and one of the plurality of rotatable supporting rollers includes a steering roller which moves said belt member in a widthwise direction by an inclining operation;

a detecting unit configured to detect a position of said belt member with respect to the widthwise direction;

a first control portion configured to correct the position of said belt member with a first predetermined amount of an inclination of said steering roller;

a second control portion configured to correct the position of said belt member with a second predetermined amount of an inclination of said steering roller in response to a positional change, having a predetermined frequency, of said belt member; and a controller configured to control the position of said belt member based on an output of said detecting unit and configured to form a feed-back loop in which the first control portion and the second control portion are connected in parallel.

2. An apparatus according to claim 1, wherein the second predetermined amount is larger than the first predetermined amount.

3. An apparatus according to claim 1, wherein said detecting unit is disposed between said steering roller and an image bearing member disposed in a downstream most position with respect to a rotational direction of said belt member.

4. An apparatus according to claim 1, wherein said second control portion changes the position of said belt member using a geometrical deviation, as seen in a direction perpendicular to a surface of said belt member, caused by an inclination of said steering roller.

5. An apparatus according to claim 1, wherein said steering roller is controlled using a sum of the amount of the inclination by said first control portion and the amount of the inclination by said second control portion.

6. An apparatus according to claim 1, wherein said detecting unit includes a pair of detecting members provided at positions different with respect to a rotational direction of said belt member, and wherein said first control portion is responsive to an output of one of said detecting members, and said second control portion is responsive to an output of the other of said detecting members.

7. An apparatus according to claim 6, wherein one of said detecting members is disposed at a position closer to said steering roller than the other of said detecting members.

8. An apparatus according to claim 6, wherein one of said detecting members is disposed adjacent to a downstream side of an image bearing member disposed in a downstream most position with respect to the rotational direction of said belt member, and the other of said detecting members is disposed adjacent to an upstream side of an image bearing member disposed in a upstream most position with respect to the rotational direction of said belt member.

* * * * *